US009931754B1

(12) United States Patent
Schmidt

(10) Patent No.: US 9,931,754 B1
(45) Date of Patent: Apr. 3, 2018

(54) DUAL SHAVING RAZOR ASSEMBLY AND CASE THEREFOR

(71) Applicant: Speed Razor, LLC, Wyckoff, NJ (US)

(72) Inventor: Kevin Schmidt, Wyckoff, NJ (US)

(73) Assignee: Speed Razor, LLC, Wyckoff, NJ (US)

( * ) Notice: Subject to any disclaimer, the term of this patent is extended or adjusted under 35 U.S.C. 154(b) by 0 days.

(21) Appl. No.: 15/617,830

(22) Filed: Jun. 8, 2017

(51) Int. Cl.

| | |
|---|---|
| ***B26B 19/00*** | (2006.01) |
| ***B26B 19/44*** | (2006.01) |
| ***B26B 21/22*** | (2006.01) |
| ***B26B 21/40*** | (2006.01) |
| ***B26B 21/52*** | (2006.01) |

(52) U.S. Cl.
CPC ..... *B26B 21/225* (2013.01); *B26B 21/40* (2013.01); *B26B 21/522* (2013.01)

(58) Field of Classification Search
CPC ..... B26B 21/446; B26B 21/14; B26B 21/225; B26B 21/40; B26B 21/522
USPC ..... 30/41, 34.1; 206/349–360
See application file for complete search history.

(56) References Cited

U.S. PATENT DOCUMENTS

| | | | | |
|---|---|---|---|---|
| 1,187,441 | A | 6/1916 | Miller | |
| 1,359,666 | A | 11/1920 | Brandt | |
| 2,150,260 | A | 3/1939 | Berry | |
| 4,461,078 | A | 7/1984 | Carreker | |
| 4,970,784 | A | 11/1990 | Althaus et al. | |
| 4,989,328 | A | 2/1991 | Sokoloff | |
| 5,426,853 | A | 6/1995 | McNinch | |
| D391,021 | S | 2/1998 | van Oene | |
| 5,865,189 | A | 2/1999 | Andrews | |
| 6,018,877 | A * | 2/2000 | Greene | B26B 21/222 30/298 |
| D423,143 | S * | 4/2000 | Cowell | D28/46 |
| 6,052,905 | A * | 4/2000 | Branchinelli | B26B 21/4006 30/34.1 |
| 6,082,007 | A | 7/2000 | Andrews | |
| 6,112,421 | A | 9/2000 | Greene | |
| 6,122,826 | A * | 9/2000 | Coffin | B26B 21/521 30/527 |

(Continued)

FOREIGN PATENT DOCUMENTS

| | | | |
|---|---|---|---|
| GB | 2457974 | A | 9/2009 |
| JP | 52015761 | A | 2/1977 |

(Continued)

*Primary Examiner* — Ghassem Alie
*Assistant Examiner* — Bharat C Patel
(74) *Attorney, Agent, or Firm* — Richard M. Goldberg

(57) ABSTRACT

A dual shaving razor assembly includes an arched central main body and first and second pairs of legs extending down from first and second sides of the main body, respectively, the legs of each pair being in spaced relation to each other. Each pair includes a securing arrangement for securing a shaving cartridge having blades thereto such that each shaving cartridge is adapted to pivot relative to the main body. First and second flexible and resilient wings extend from the first and second sides, respectively, of the main body between the first and second pairs of legs to a position immediately above a respective shaving cartridge held by the respective pair of legs. The wings are adapted to engage an upper surface of the respective cartridge to pivot the shaving cartridge relative to the main body upon application of an external force to the respective flexible and resilient wing.

20 Claims, 27 Drawing Sheets

(56) References Cited

U.S. PATENT DOCUMENTS 6,125,857 A 10/2000 Silber
6,161,288 A * 12/2000 Andrews ..... B26B 21/00 30/50
6,434,828 B1 * 8/2002 Andrews ..... B26B 21/00 30/50
6,493,950 B1 * 12/2002 Kludjian ..... B26B 21/22 30/298
6,550,148 B2 * 4/2003 Cecil ..... B26B 21/22 30/50
6,560,876 B2 5/2003 Carr
6,694,626 B2 * 2/2004 Kludjian ..... B26B 21/22 30/298
6,823,594 B2 11/2004 Kludjian et al.
7,140,115 B2 11/2006 Greene
D578,708 S 10/2008 Ringart et al.
D585,157 S 1/2009 Park
7,574,809 B2 8/2009 Follo et al.
7,726,032 B1 * 6/2010 Hernandez ..... B26B 21/523 30/334
8,387,259 B2 3/2013 Starr
8,528,213 B2 * 9/2013 Szczepanowski .... B26B 21/405 219/385
8,672,128 B2 * 3/2014 Davis ..... A61L 2/23 206/205
8,707,561 B1 * 4/2014 Kneier ..... B26B 19/42 30/34.2
8,782,911 B1 * 7/2014 Greene ..... B26B 21/52 30/298
D744,744 S * 12/2015 Lee ..... D3/205
D745,775 S * 12/2015 Provost ..... D3/205
9,259,593 B2 * 2/2016 Roach ..... A61N 1/3968
D779,233 S * 2/2017 Williams ..... D6/574
9,581,341 B1 * 2/2017 Krok ..... A45D 27/225
D782,183 S * 3/2017 de Vries ..... D3/205
9,630,333 B2 * 4/2017 Manshoory ..... B26B 21/446
D788,600 S * 6/2017 Lee ..... D9/749
2002/0050065 A1 5/2002 Kludjian et al.
2002/0194735 A1 12/2002 Carr
2003/0033717 A1 2/2003 Cecil
2005/0066532 A1 3/2005 Kludjian et al.
2007/0184011 A1 * 8/2007 Herlands ..... A61K 8/361 424/73
2010/0183814 A1 * 7/2010 Rios ..... E04F 15/02161 427/387
2014/0096395 A1 * 4/2014 Griner ..... B26B 21/10 30/40
2014/0230257 A1 * 8/2014 Eagleton ..... B26B 21/522 30/526
2015/0183119 A1 * 7/2015 Contaldi ..... B26B 21/522 132/200
2016/0193740 A1 * 7/2016 Phillips ..... B26B 21/527 30/34.05
2016/0288350 A1 * 10/2016 Contaldi ..... B26B 21/522

FOREIGN PATENT DOCUMENTS

WO 9725189 A1 7/1997
WO 2012120499 A1 9/2012

* cited by examiner

DUAL SHAVING RAZOR ASSEMBLY AND CASE THEREFOR

BACKGROUND OF THE INVENTION

The present invention relates generally to shaving razors, and more particularly, to a dual razor assembly having to razor heads at opposite ends of the assembly.

Conventionally, a manual shaver includes a handle and a shaving head at one end of the handle, with the shaving head adapted to hold a razor assembly therein. The razor assembly can hold one or more parallel blades for shaving purposes. For example, two or more parallel blades may be mounted one behind the other for the purpose of producing a closer shave. However, because of this arrangement, the razor can only shave in one direction at a time.

Further, because such razors are held by the handle during shaving, the force applied by the shaving head on the skin is a result of a torque or moment of force, rather than a direct force on the razor head. As a result, it is more difficult to control the shaving operation.

Still further, each time the razor is raised up from the skin and placed down on another location of the skin for shaving, the occurrence of nicks and cuts on the skin becomes greater. In other words, nicks and cuts generally do not occur while the razor is in contact with the skin during a shaving operation.

In this regard, it is known to provide a dual shaving razor assembly that includes two razor heads, one at each end thereof. With these types of dual shaving razor assemblies, the user's index and ring fingers are positioned directly over the respective razor heads for better control of the shaving operation. In addition, because of the use of two razor heads, the dual shaving razor assembly can shave bi-directionally in two opposite directions, thereby reducing the shaving time as well. Examples of such dual shaving razor assemblies are shown in PCT Patent Publication No. WO 2012/120499 and U.S. Patent Publication No. 2016/0288350.

However, with such known dual shaving razor assemblies, the angles and orientations of the razor heads cannot be satisfactorily controlled.

For example, in PCT Patent Publication No. WO 2012/120499, the shaving cartridges are fixed in a non-rotatable manner to the main body which is constituted by a flexible arch. As shown in FIGS. 4 and 5 of this patent publication, in order to adjust the angle of the shaving cartridges relative to the skin surface, and thereby, the angle of the shaving blades relative to the skin surface, a downward pressure is applied to the center of the flexible arch. As can be seen from the drawings, the cartridges are now in greater pressure contact with the skin.

This arrangement has the disadvantage that a relatively large pressure must be applied to the flexible arch. This is because of the relatively thick main body. This large pressure, in turn, results in a large pressure being applied to the shaving cartridges, which is disadvantageous from a shaving perspective. Specifically, the free end of each shaving cartridge is rotated upwardly relative to the skin surface with the bending of the flexible arch or main body. As a result, a large amount of pressure is applied to the shaving cartridges. It would be much more desirable to rotate the free end of each shaving cartridge in an opposite downward direction, whereby the shaving cartridge merely lies on top of the skin without such greater pressure added thereto.

In addition, this patent publication is limited in that both shaving cartridges must be rotated at the same time with the same pressure. This is because of the downward pressure applied to the center of the flexible arch. It would be much more desirable to separately control the rotation of, and pressure on, each shaving cartridge.

Lastly, because of the unitary body construction of the flexible arch, there is no transverse rotation of the shaving cartridges relative to each other, thereby providing even less shaving control.

U.S. Patent Publication No. 2016/0288350 discloses another known dual shaving razor assembly. In the first embodiment of FIGS. 1-7, there is no rotation of shaving cartridges relative to the sides 160 and 170 of the arch 150. In other words, the shaving cartridges are fixed in position to the ends of the sides 160 and 170. This is because of the rectangular unnumbered inwardly extending projections shown best at the ends of the arms 211 in FIG. 1B of this patent publication, which fit within corresponding rectangular recesses in the ends of the shaving cartridges.

In the second embodiment of FIGS. 8-14 of this patent publication, although semi-circular leg feet 330 are provided at the ends of legs 324 for insertion within circular openings in the shaving cartridges, this patent publication provides additional structure to ensure that there is no rotation of the shaving cartridges relative to the arms. Specifically, to prevent rotation in a first direction, handle supports 335 are added which contact the retainment body support 325 extending upwardly from the center of each shaving cartridge. As stated in paragraph [0065], this functions to prevent or limit rotation of the razor cartridges while the razor is in use. This is because handle supports 335 are rigid members which are not capable of flexing. If handle supports 335 were flexible, they would not prevent or limit rotation of the razor cartridges. To prevent rotation in the second opposite direction, triangular shaped projections extend from the bottom of legs 320, at the free ends thereof, for engaging a respective surface of the shaving cartridge. Thus, rotation of the shaving cartridges relative to the legs is prevented.

For this reason, this patent is intended to apply only one shaving cartridge at a time in contact with the skin during a shaving operation, as stated in paragraph [0069] of this patent publication. As such, this razor operates in a similar manner to a conventional razor which must be continuously picked up from the skin and replaced in contact with the skin at a different location. As discussed above, such an operation results in nicks and cuts on the skin.

Further, since the shaving cartridges in this patent publication do not rotate relative to the main body, control of the shaving operation, and particularly, the orientation of the shaving cartridges and pressure applied, is restricted, producing a less than desirable shaving operation.

Thus, this patent publication still suffers from the deficiencies of PCT Patent Publication No. WO 2012/120499, as discussed above.

It would therefore be desirable to provide a dual shaving razor assembly, which permits separate rotation of each shaving cartridge relative to the main body in order to merely place the shaving cartridge on skin at a different angle without applying undue pressure, while retaining both shaving cartridges in contact with the skin during a shaving operation. It would also be desirable to provide for transverse rotation of each shaving cartridge relative to the other to provide even more control in the shaving operation.

SUMMARY OF THE INVENTION

Accordingly, it is an object of the present invention to provide a dual shaving razor assembly that overcomes the aforementioned problems.

It is another object of the present invention to provide a dual shaving razor assembly in which each shaving cartridge is connected to the main body for rotation or pivoting movement relative to the main body.

It is still another object of the present invention to provide a dual shaving razor assembly which separately controls the angle of orientation of each shaving cartridge relative to the main body.

It is yet another object of the present invention to provide a dual shaving razor assembly in which each shaving cartridge is adapted to rotate separately to accommodate skin orientation, without applying undue pressure to the skin.

It is a further object of the present invention to provide a dual shaving razor assembly which permits transverse rotation of the two shaving cartridges relative to each other.

It is a still further object of the present invention to provide a case for holding the dual shaving razor assembly safely without damage to the blades of the shaving cartridges, and without injury to a person, while also providing for easy transport of the dual shaving razor assembly.

It is a yet further object of the present invention to provide a dual shaving razor assembly that is easy and economical to use and manufacture.

In accordance with an aspect of the present invention, a dual shaving razor assembly includes a central main body; a first pair of legs extending down from a first side of the main body in spaced relation to each other; and a second pair of legs extending down from an opposite second side of the main body in spaced relation to each other. Each pair of legs includes a securing arrangement for securing a shaving cartridge having blades thereto such that each shaving cartridge is adapted to pivot relative to the main body. A first flexible and resilient wing extends from the first side of the main body between the first pair of legs to a position immediately above a respective first shaving cartridge held by the first pair of legs, and is adapted to engage an upper surface of the first shaving cartridge to pivot the first shaving cartridge relative to the main body upon application of an external force to the first flexible and resilient wing. A second flexible and resilient wing extends from the second side of the main body between the second pair of legs to a position immediately above a respective second shaving cartridge held by the first pair of legs, and is adapted to engage an upper surface of the second shaving cartridge to pivot the second shaving cartridge relative to the main body, independently of any pivoting of the first shaving cartridge, upon application of an external force to the first flexible and resilient wing.

Each securing arrangement includes a pivot securing arrangement for pivotally securing each razor cartridge to one pair of legs. Specifically, each razor cartridge has opposed cylindrical openings, and each pivot securing arrangement includes cylindrical pegs adapted to be rotatably received in the opposed cylindrical openings. Further, the legs are flexible and resilient to permit pivoting of the shaving cartridges relative to the main body in a lengthwise direction of the dual shaving razor assembly. In this regard, the legs have a length with a generally constant thickness throughout the length.

Preferably, the main body has an arcuate shape for receiving a middle finger therebeneath and each wing has an arcuate shape for receiving one of an index finger and ring finger thereon. Also, preferably, each wing has an upper surface with a non-slip material thereon.

Each wing also has an elongated narrow rib on an underside thereof for engaging with a crest wall on an upper surface of the respective shaving cartridge.

Preferably, the main body includes a first body segment and a second body segment rotatable relative to each other in a transverse twisting direction. The first body segment and the second body segment include mutually facing surfaces. Specifically, the first body segment includes a central opening which extends through the surface thereof, and the second body segment includes a projection extending from the surface thereof and which is rotatably received in the central opening.

In one embodiment, there is a securement plate for capturing the projection in the central opening. In another embodiment, the first body segment includes a slot at a lower surface thereof in communication with the central opening, and the projection includes an annular recess; and a clip is provided for insertion in the slot for engagement in the annular recess to prevent axial movement of the projection in the central opening, while permitting rotation of the projection in the central opening.

Also, the first body segment includes at least one recess to one side of the central opening, and at least one stop member is provided and is received in the at least one recess for limiting an angular extent of rotation of the projection in the central opening.

In one embodiment, each recess is in open communication with the central opening, and each stop member extends radially from the projection. In another embodiment, each recess is spaced from the central opening, and each stop member includes a projection extending from the surface of the second body segment and which is rotatably received in the recess.

In accordance with another aspect of the present invention, a case is provided for holding a dual shaving razor assembly of the type described above. The case includes a base including a center convex wall portion for supporting the arcuate main body thereon, leg receiving passageways in the convex wall portion for receiving the legs of the dual razor shaving assembly, and a recess adjacent each end of the center convex wall portion, each for receiving a respective shaving cartridge securing to ends of each pair of legs; and a cover adapted to be removably secured to the base in covering relation to the dual razor shaving assembly mounted to the base.

Further, the center convex wall portion further includes a recess for receiving a respective the rib on an underside of each wing.

The base further includes recesses on opposite sides of the center convex wall portion, and the cover includes side walls with tabs adapted to be received in the recesses for removably securing the cover to the base.

The above and other features of the invention will become readily apparent from the following detailed description thereof which is to be read in connection with the accompanying drawings.

DETAILED DESCRIPTION

Figure 1:
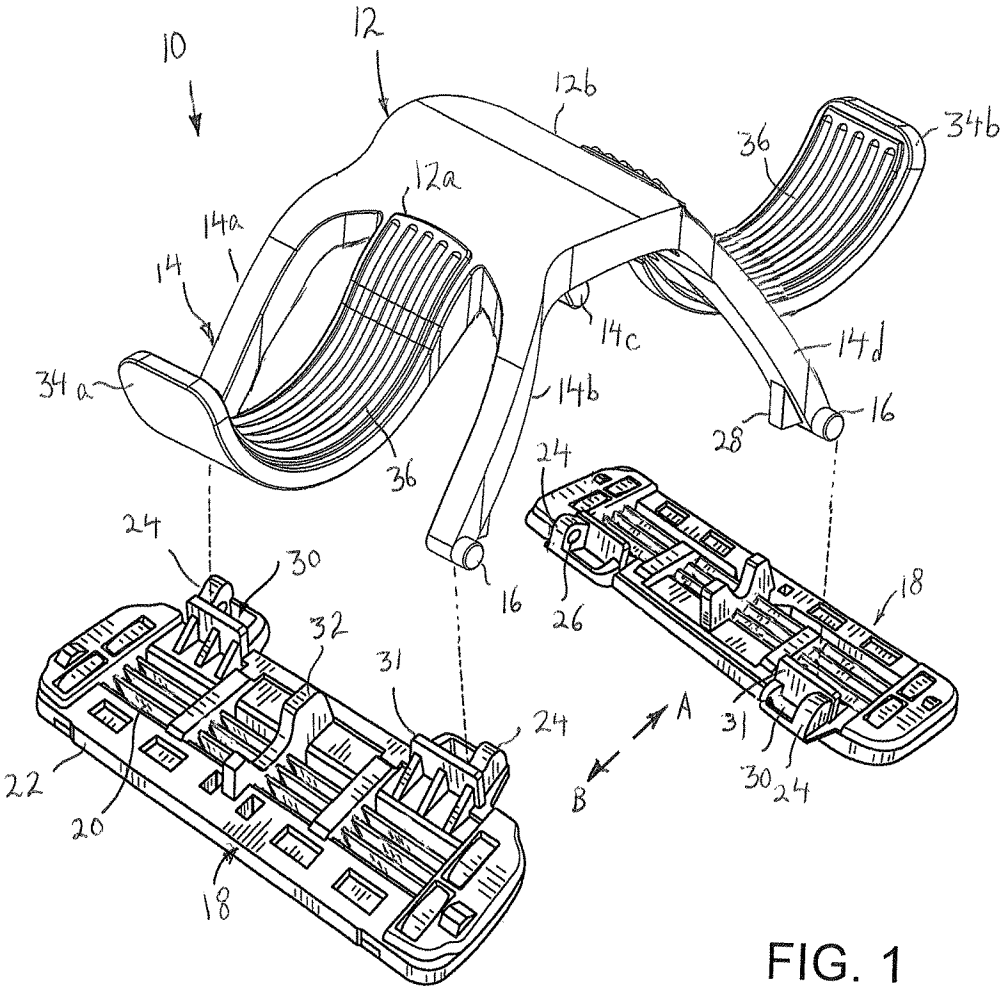
FIG. 1 is a top perspective view of a dual shaving razor assembly according to a first embodiment of the present invention.
Figure 2:
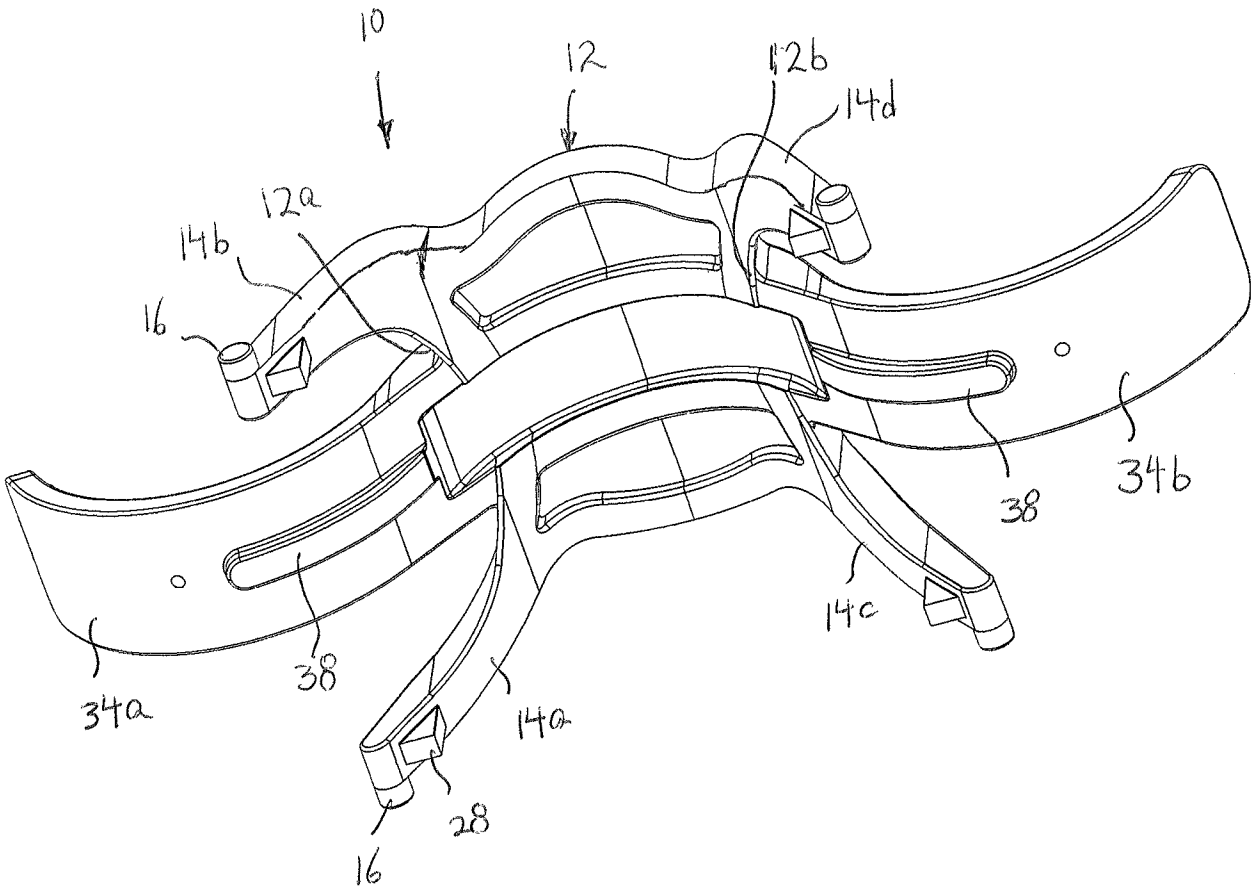
FIG. 2 is a bottom perspective view of dual shaving razor assembly.
Figure 3:
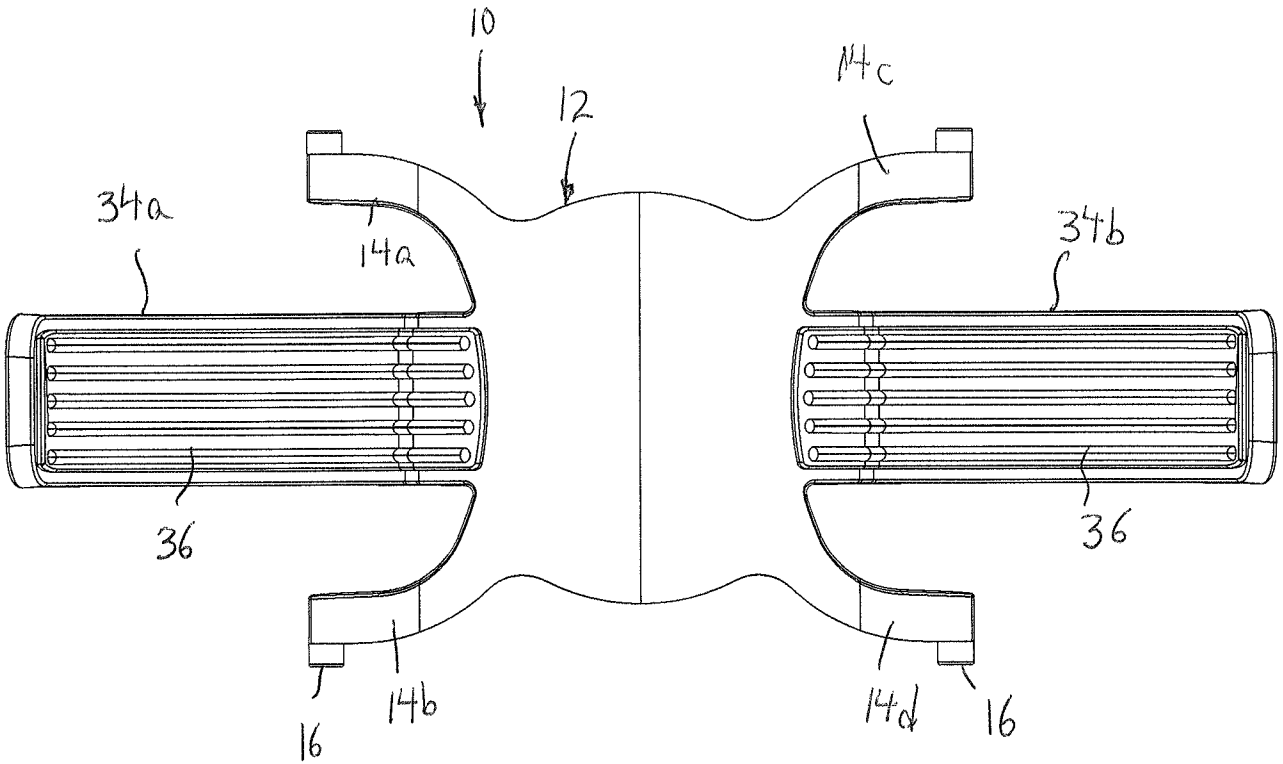
FIG. 3 is a top plan view of the dual shaving razor assembly.
Figure 4:
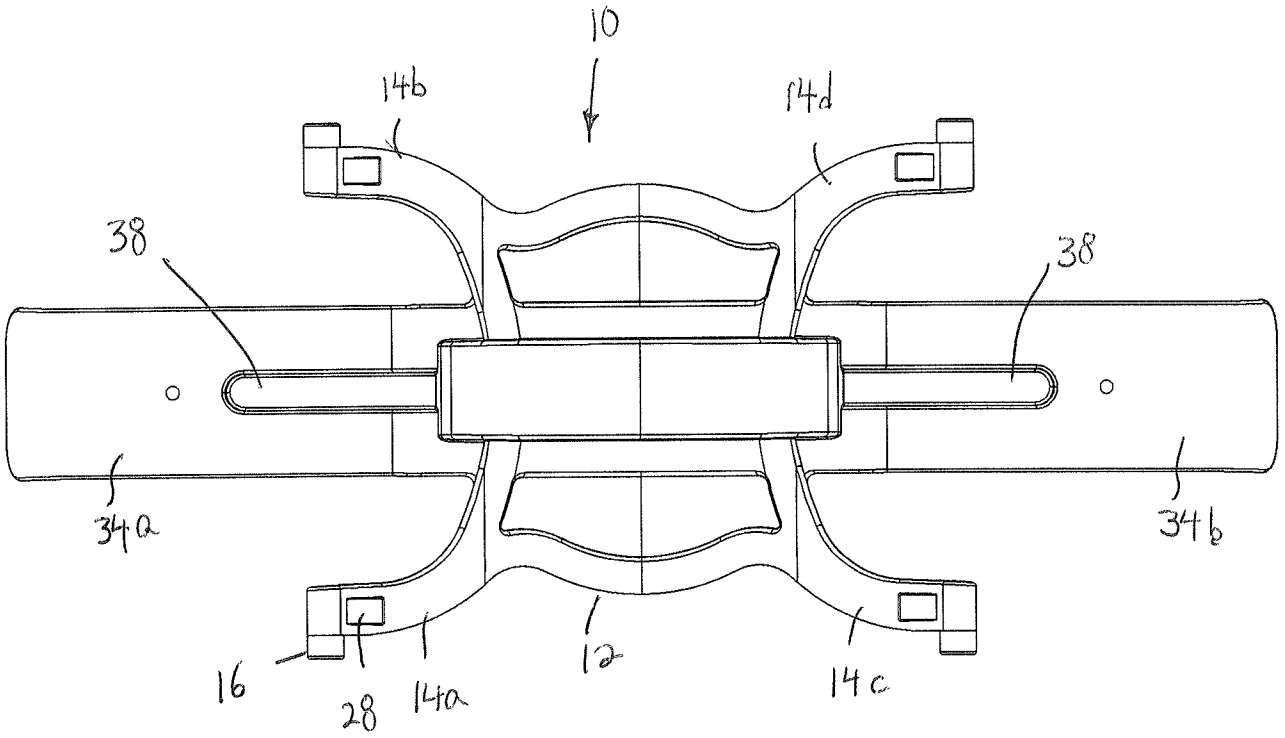
FIG. 4 is a bottom plan view of the dual shaving razor assembly.
Figure 5:
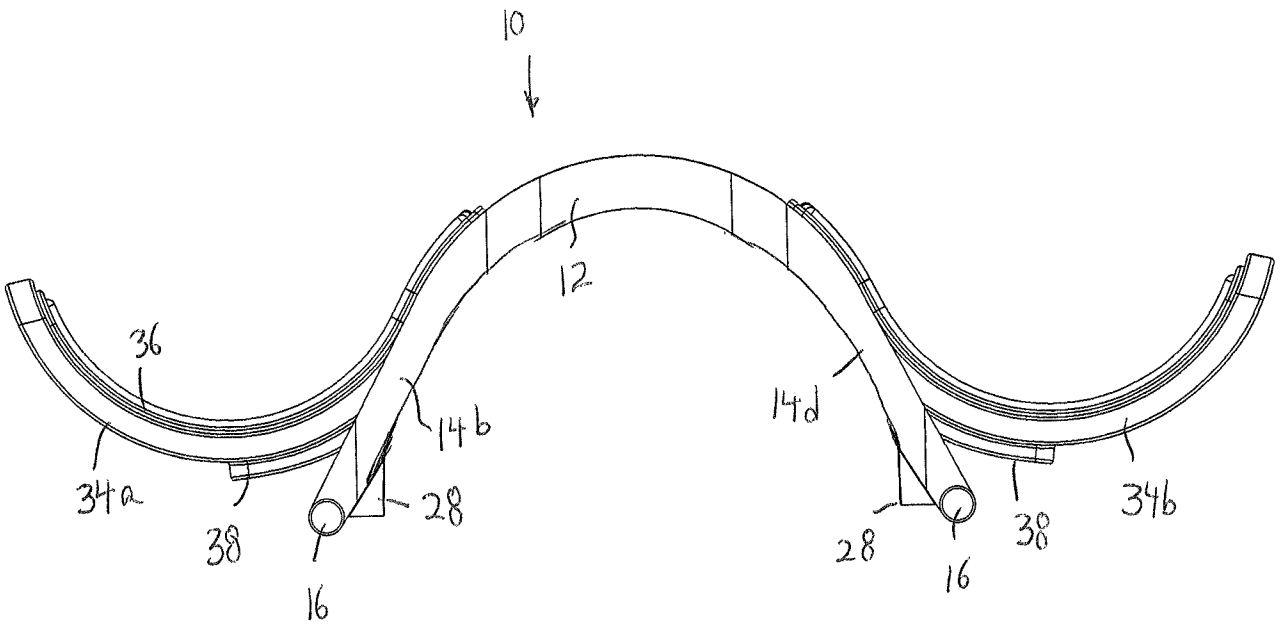
FIG. 5 is a side elevational view of the dual shaving razor assembly.
Figure 6:
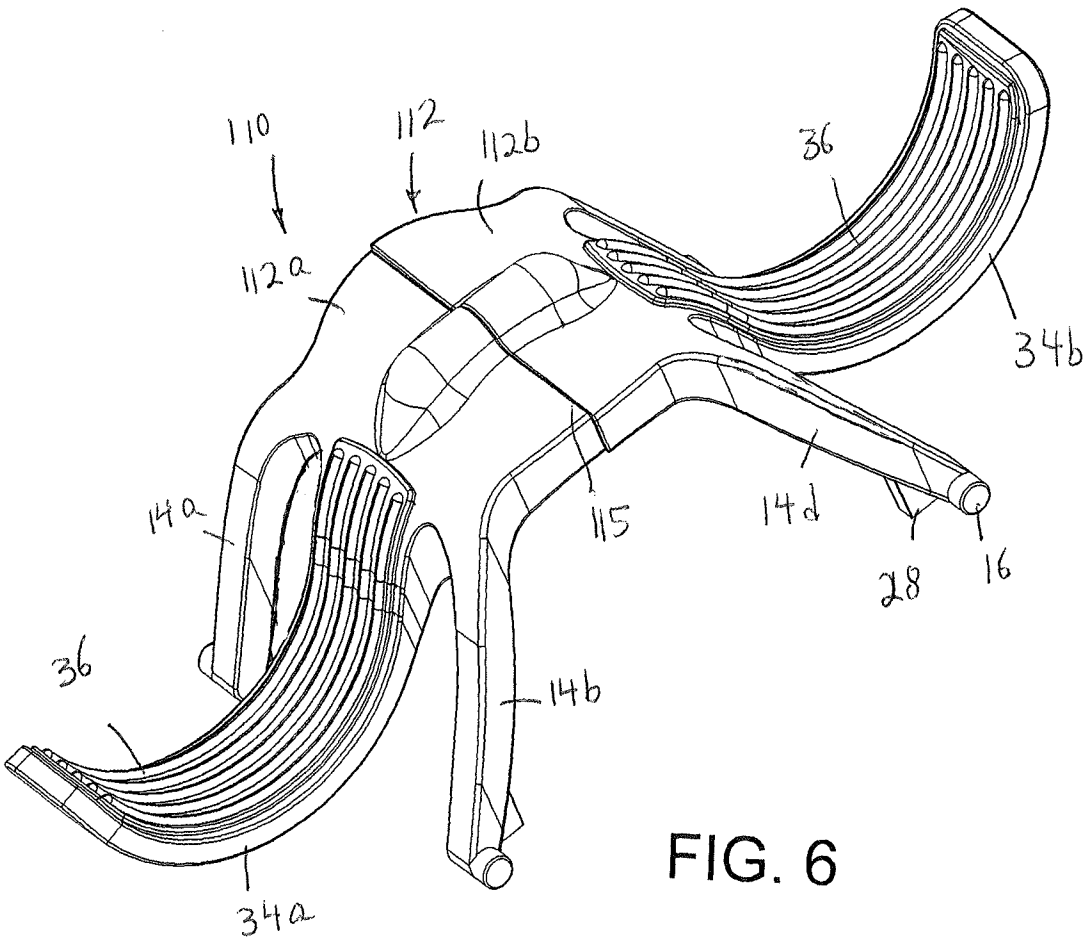
FIG. 6 is a top perspective view of a dual shaving razor assembly according to a second embodiment of the present invention, in a slightly twisted position.
Figure 7:
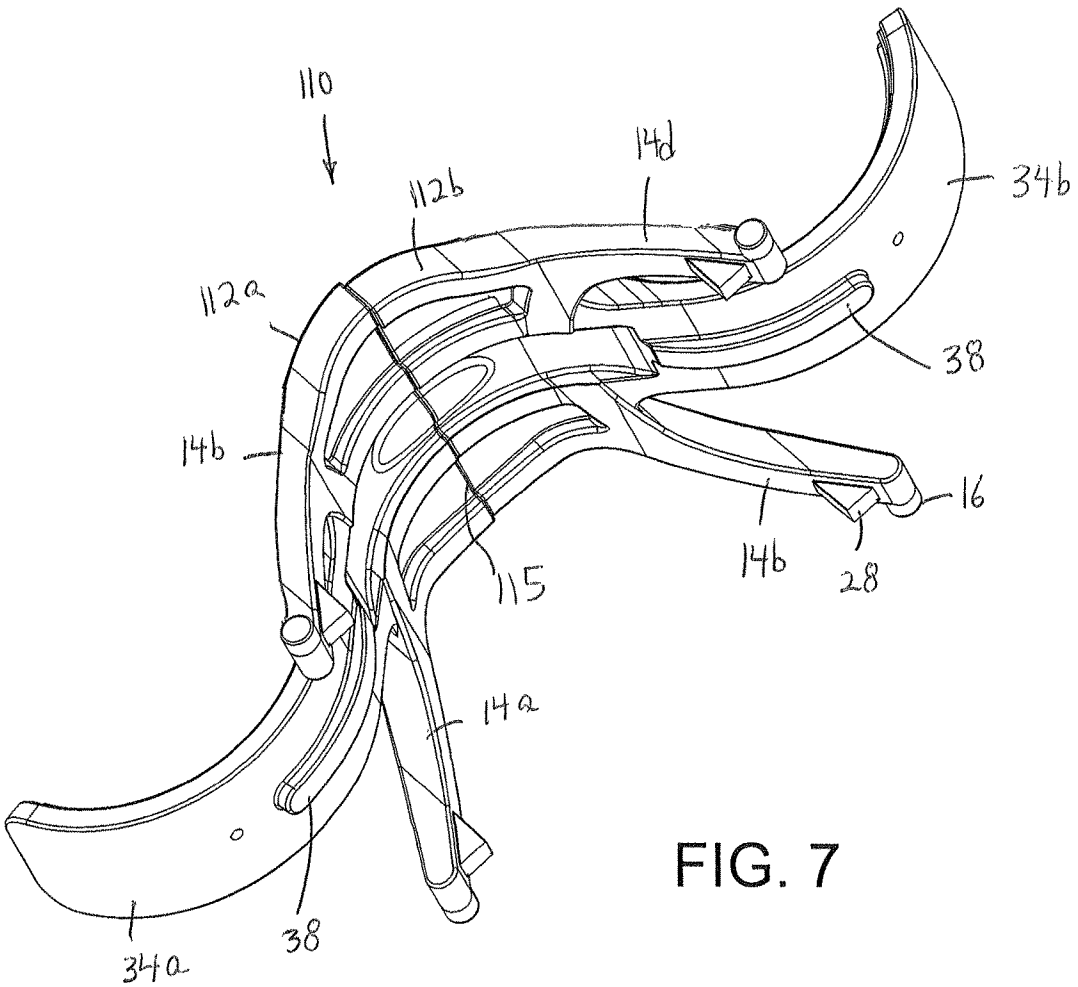
FIG. 7 is a bottom perspective view of the dual shaving razor assembly of FIG. 6.
Figure 8:
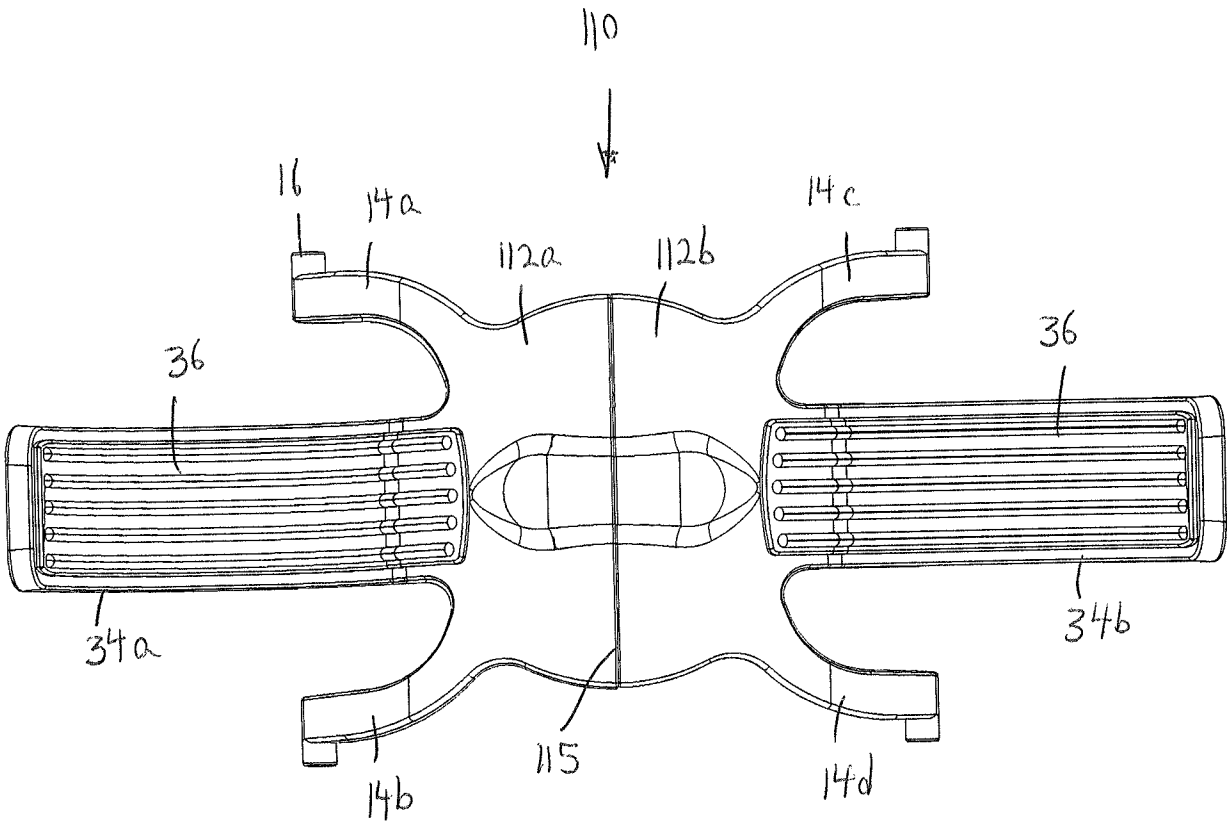
FIG. 8 is a top plan view of the dual shaving razor assembly of FIG. 6.

Referring initially to FIGS. 1-5, there is shown a first embodiment of a dual shaving razor assembly 10 according to the present invention. Dual shaving razor assembly 10 includes a main arch-like body 12, preferably having a square or rectangular shape with straight or rounded side edges, although the present invention is not limited to the shape. Main body 12 is curved from front to back so as to have an upwardly bowed configuration.

Four legs 14 extend from the corners of main body 12 in a downwardly angled manner of about 45°. Each leg 14 is also preferably slightly outwardly curved or bowed, as shown best in FIGS. 3 and 4, for better stability of dual shaving razor assembly 10 on the skin of a person. Specifically, there are two spaced apart legs 14*a* and 14*b* extending forwardly from the corners at the front edge 12*a* of main body 12, and two spaced apart legs 14*c* and 14*d* extending rearwardly from the corners at the rear edge 12*b* of main body 12. A cylindrical peg 16 extends outwardly from an outer side surface of each leg 14, at the lower end thereof.

Figure 9:
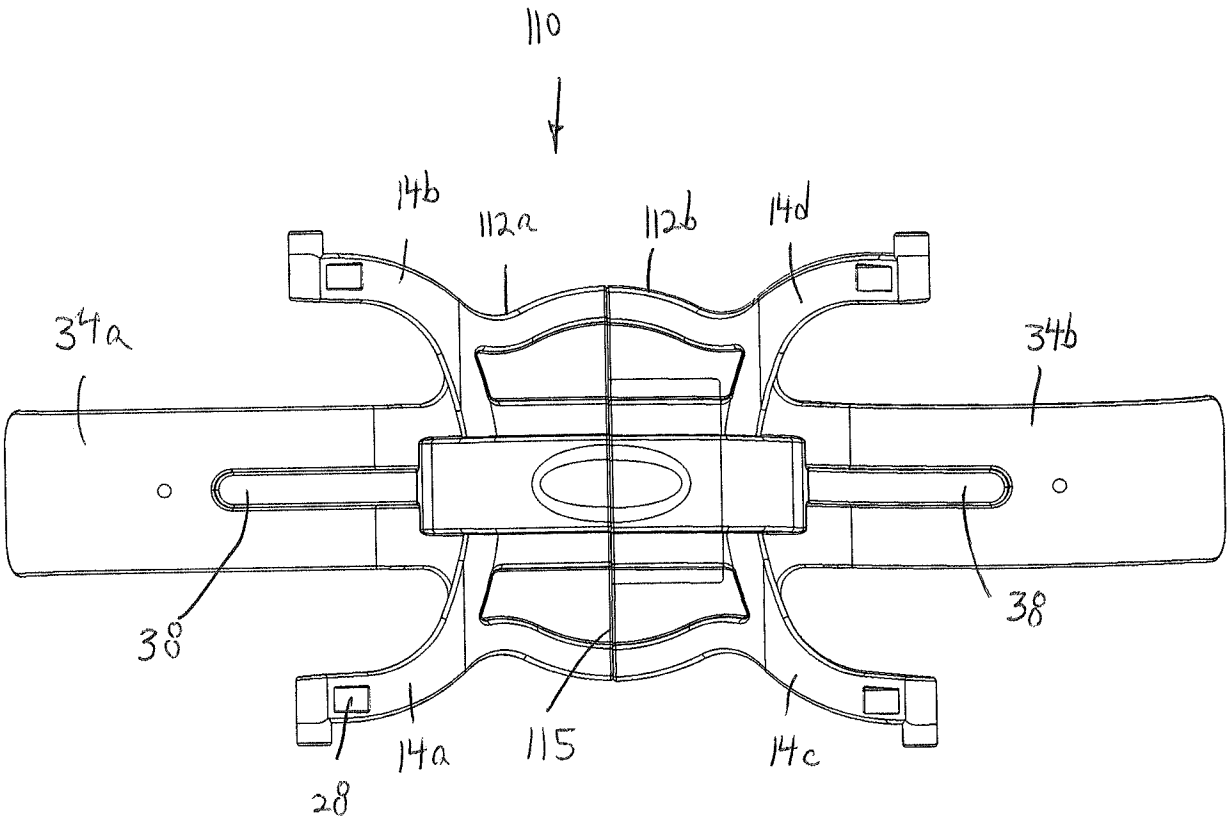
FIG. 9 is a bottom plan view of the dual shaving razor assembly of FIG. 6.
Figure 10:
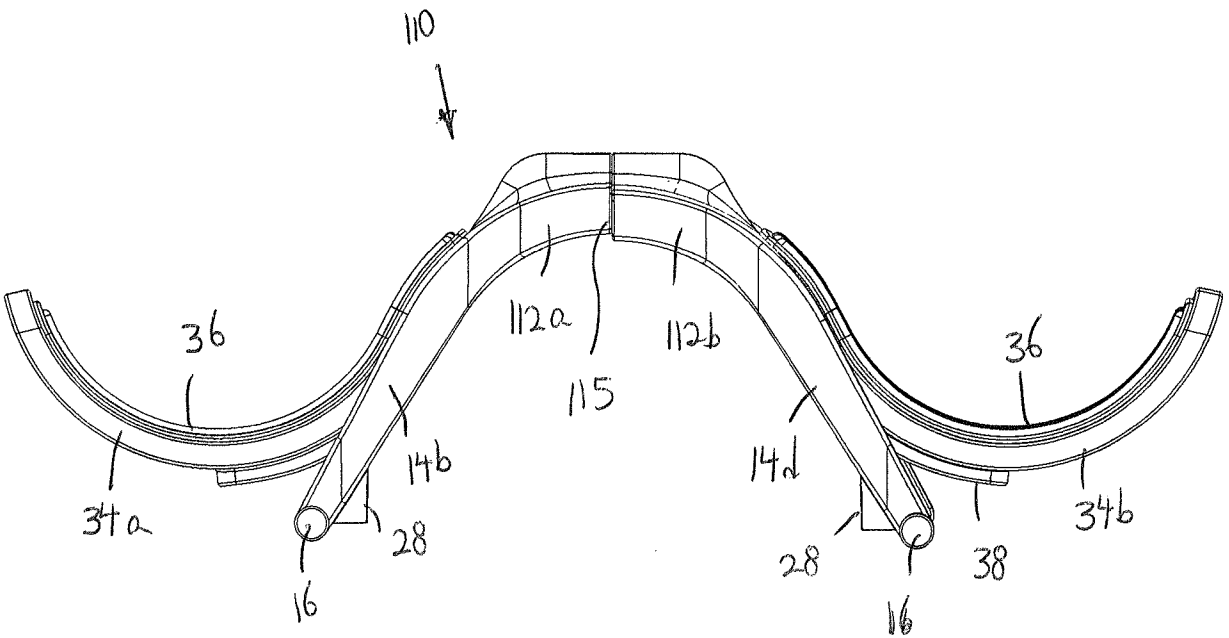
FIG. 10 is a side elevational view of the dual shaving razor assembly of FIG. 6.
Figure 11:
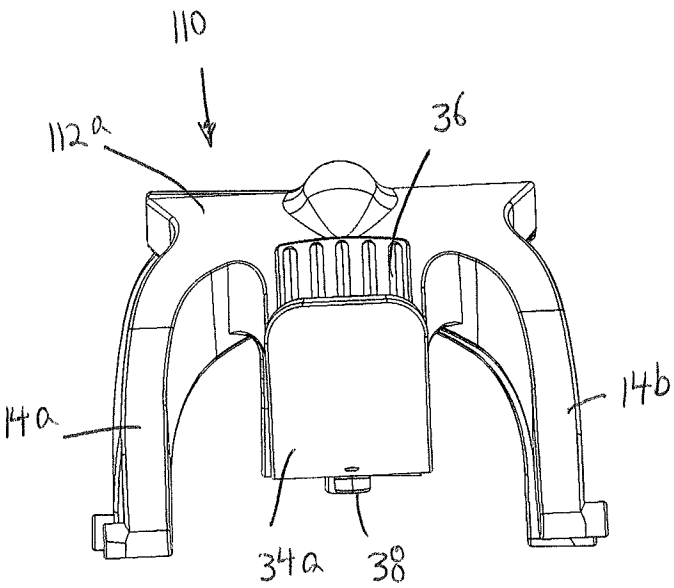
FIG. 11 is an end elevational view of the dual shaving razor assembly of FIG. 6.
Figure 12:
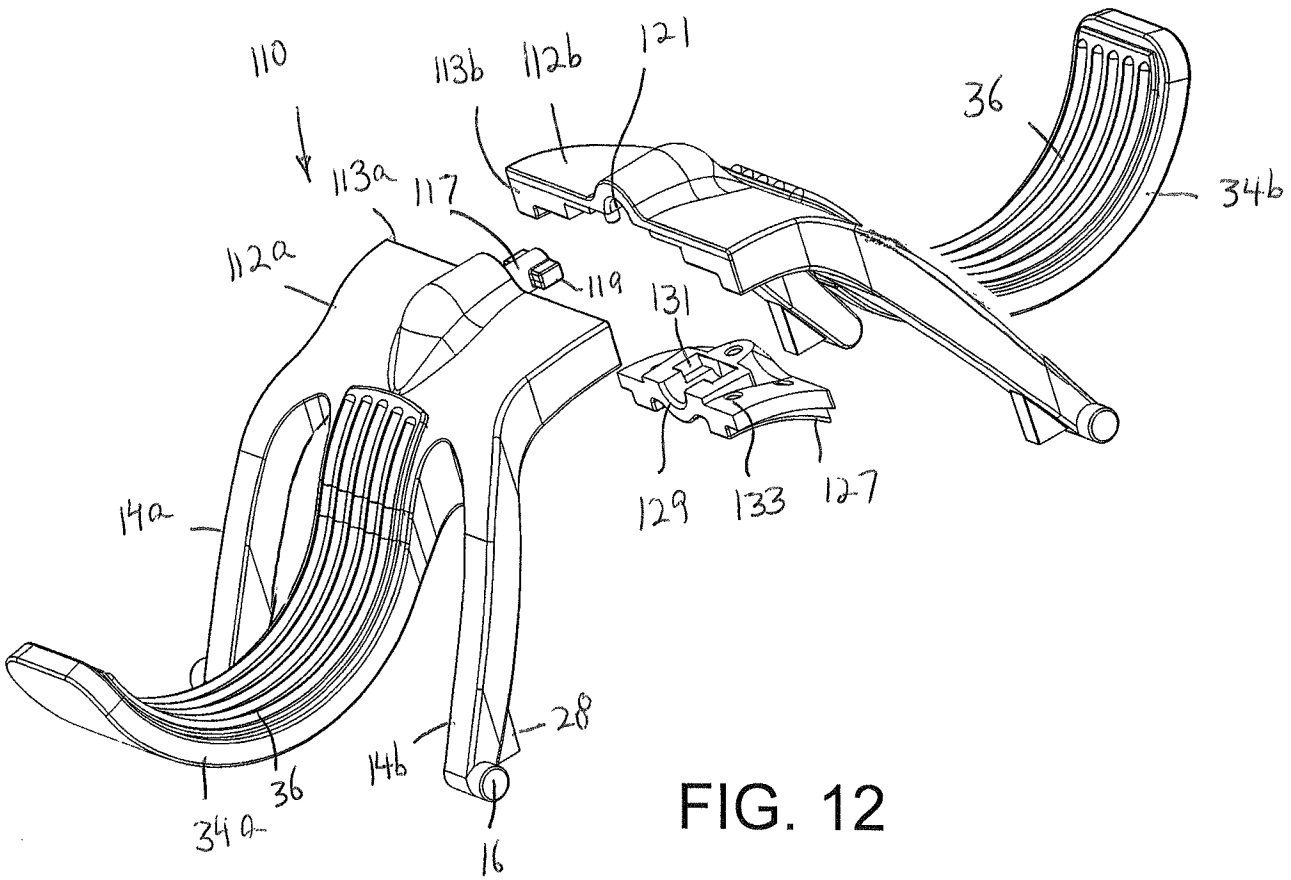
FIG. 12 is an exploded, top perspective view of the dual shaving razor assembly of FIG. 6.
Figure 13:
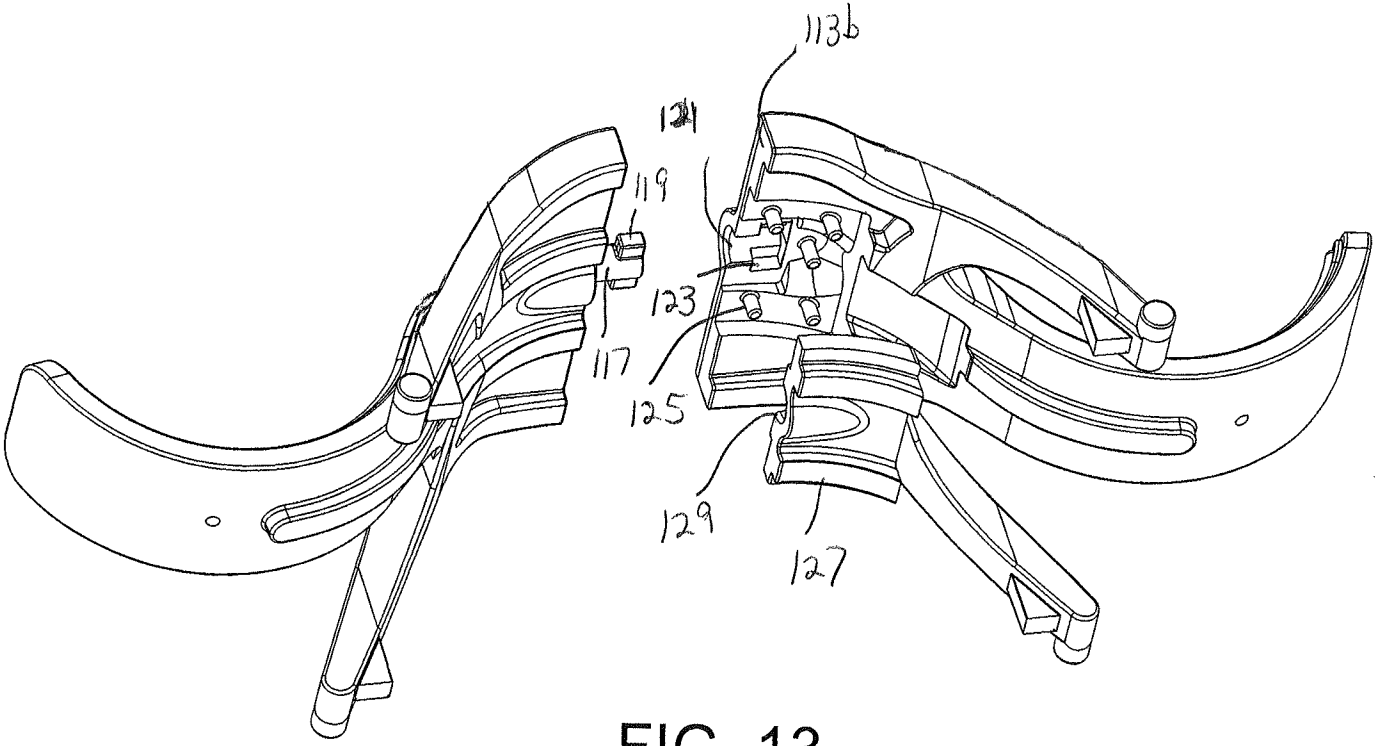
FIG. 13 is an exploded, bottom perspective view of the dual shaving razor assembly of FIG. 6.
Figure 14:
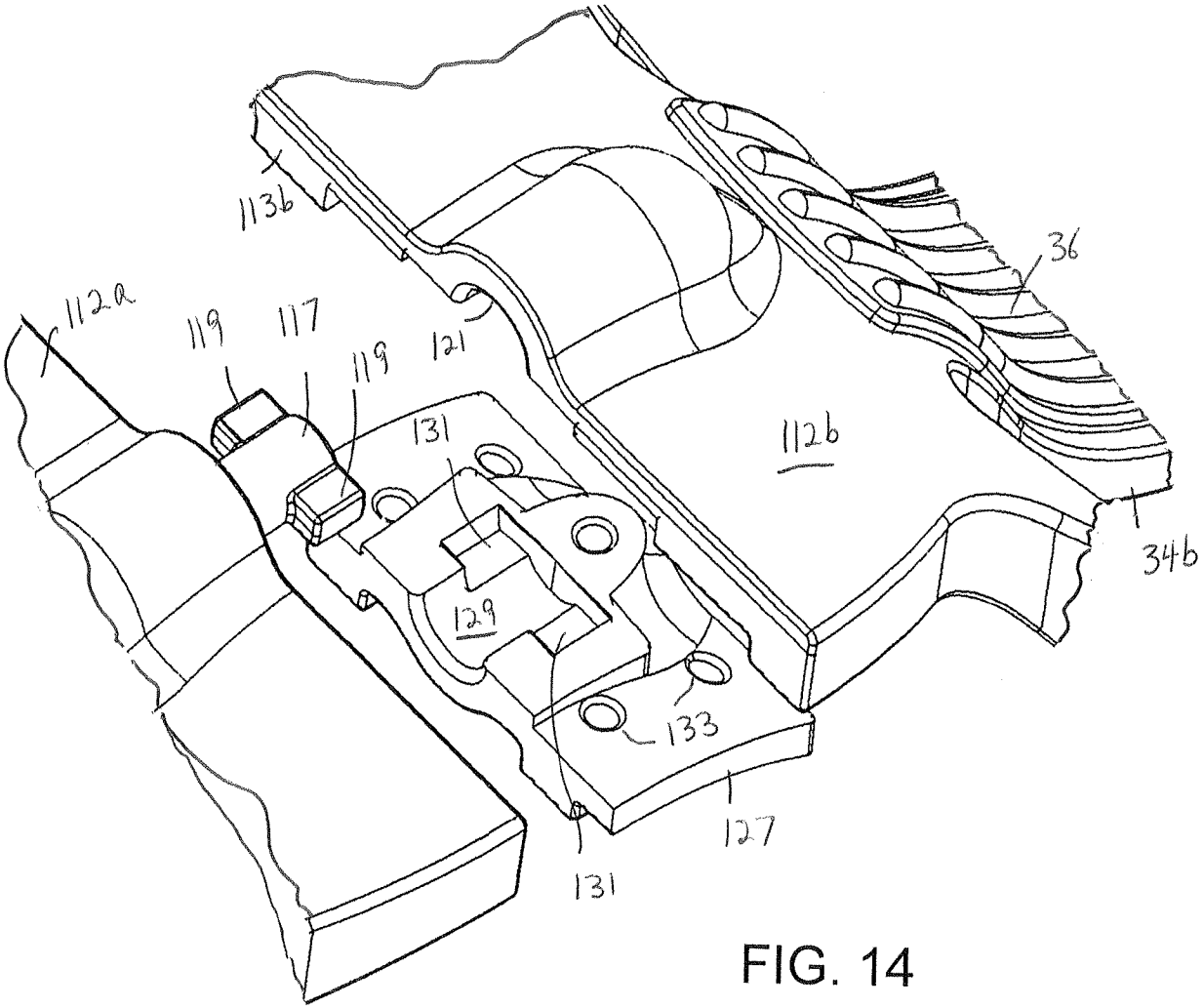
FIG. 14 is an enlarged top perspective view of a portion of the exploded dual shaving razor assembly of FIG. 12.
Figure 15:
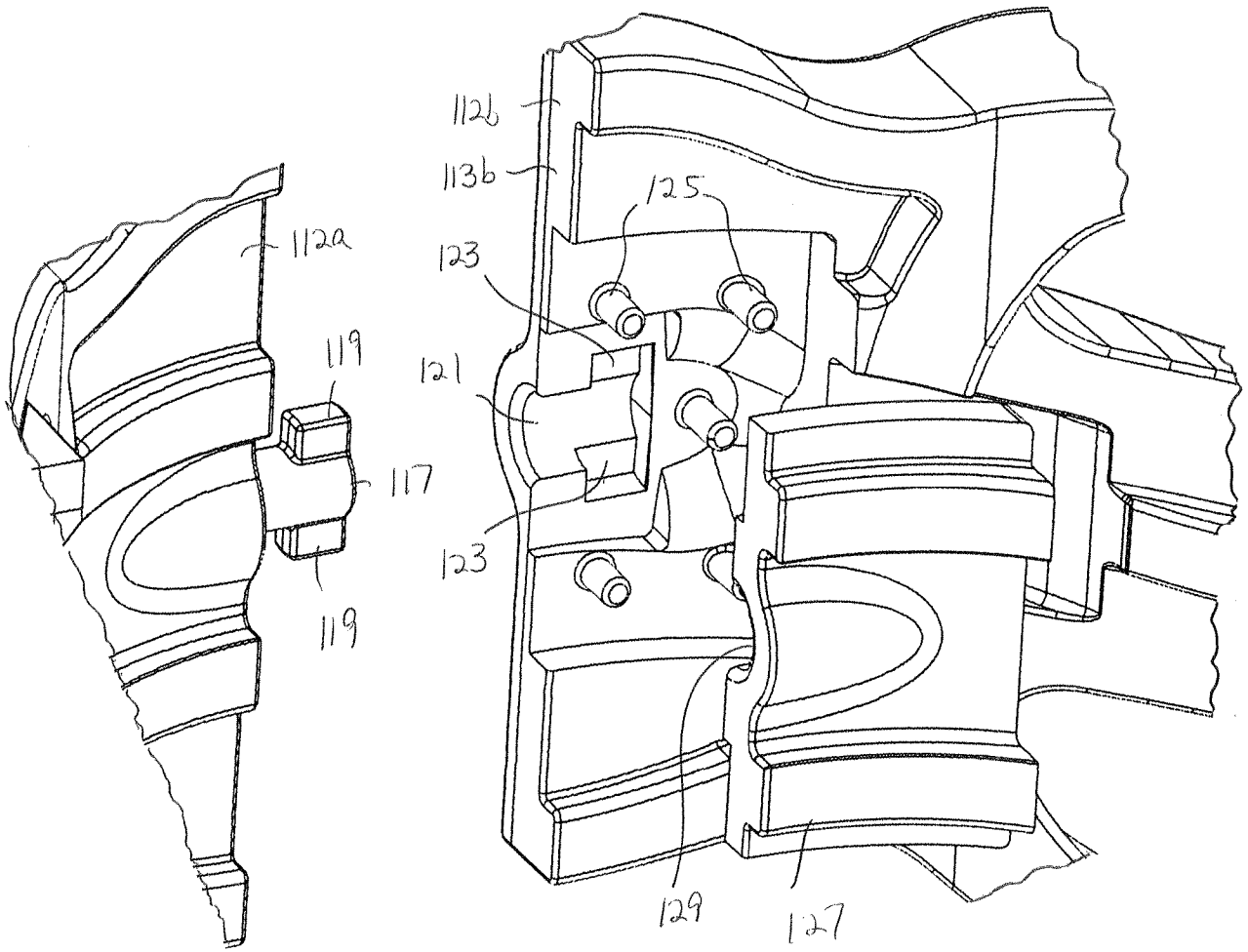
FIG. 15 is an enlarged bottom perspective view of a portion of a outreach volcano on the back is how you doing all office some boys text the exploded dual shaving razor assembly of FIG. 13.
Figure 16:
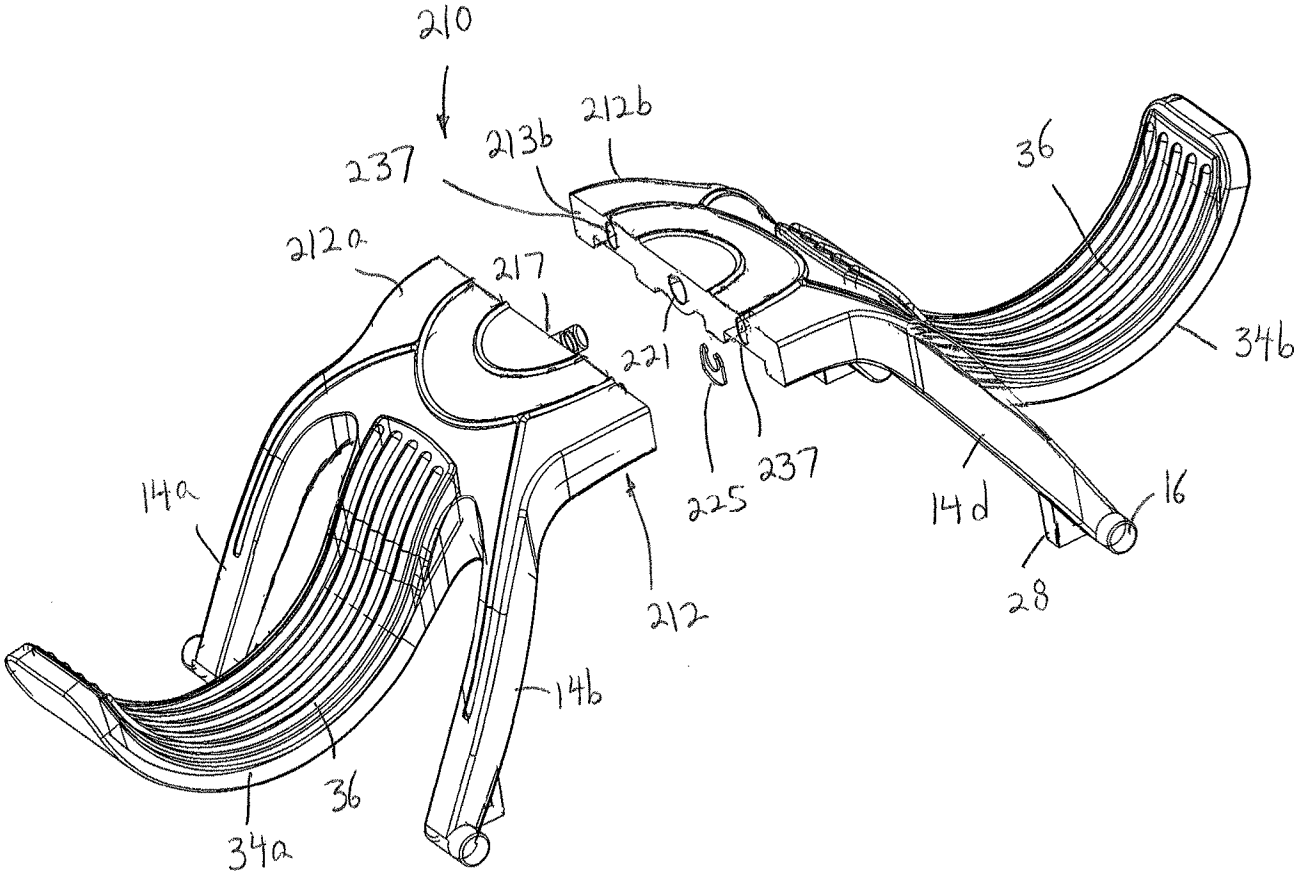
FIG. 16 is an exploded, top perspective view of a dual shaving razor assembly according to a third embodiment of the present invention.
Figure 17:
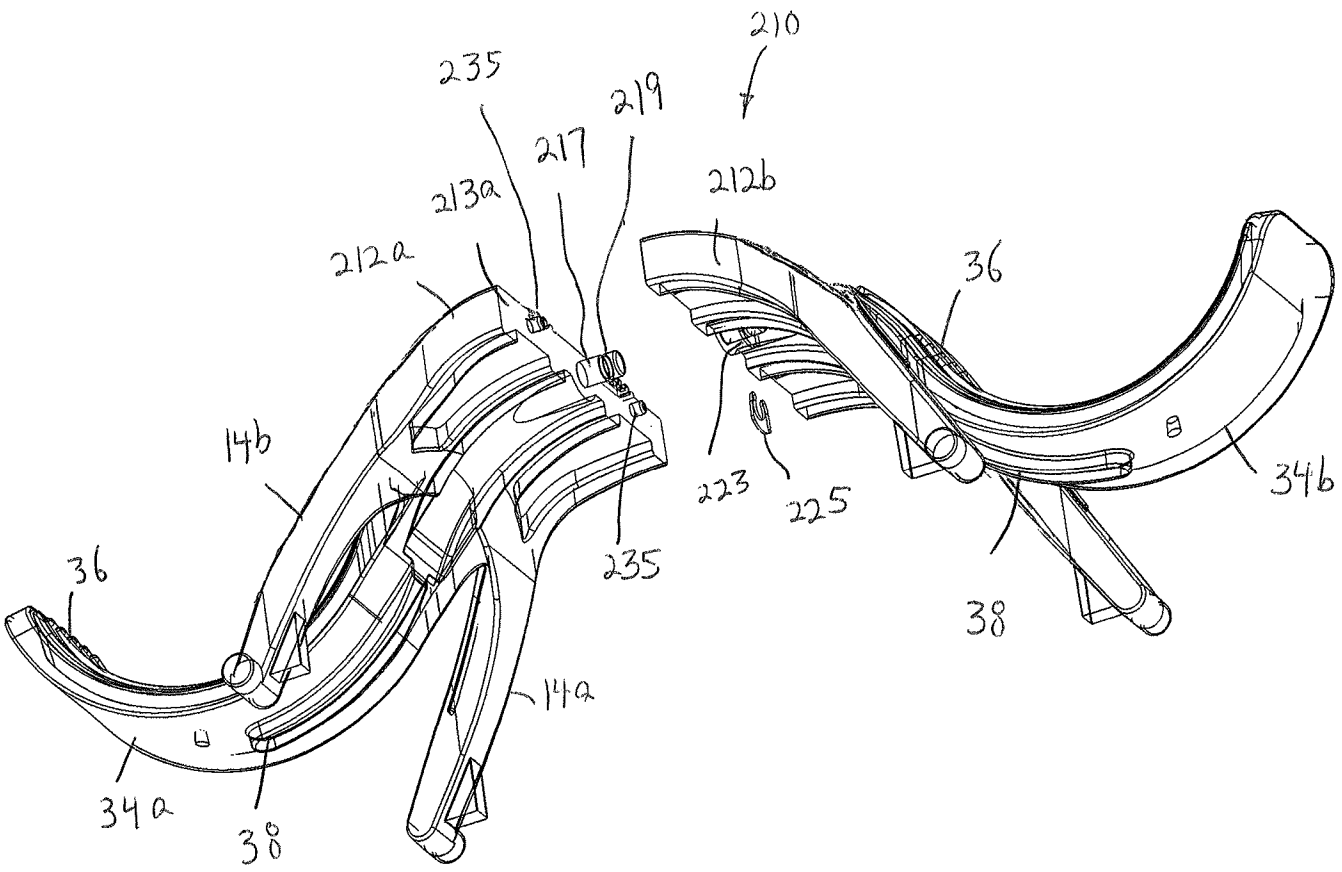
FIG. 17 is a bottom perspective view of the exploded dual shaving razor assembly of FIG. 16.
Figure 18:
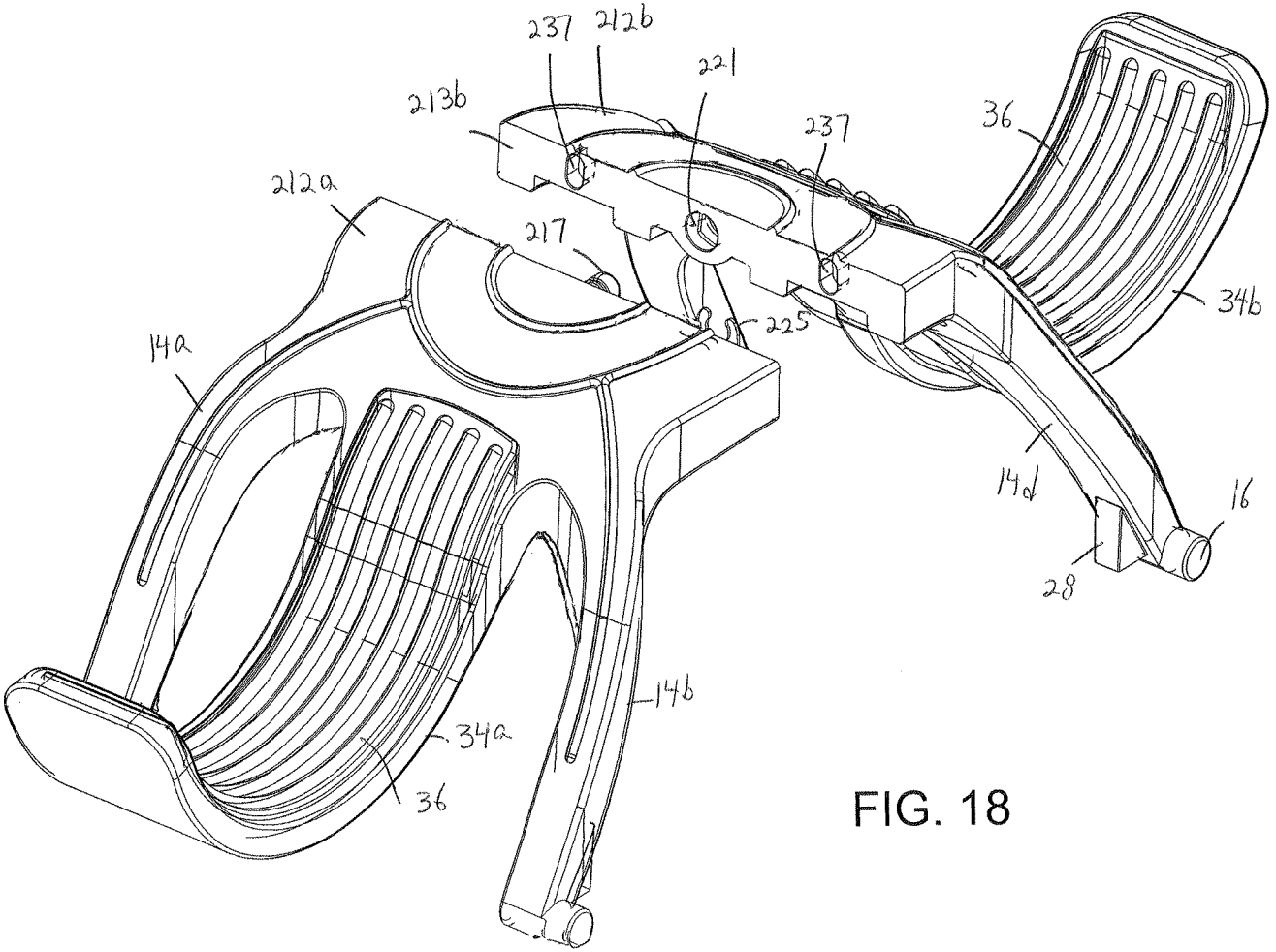
FIG. 18 is an enlarged, top perspective view of the exploded dual shaving razor assembly of FIG. 16, from a first direction.
Figure 19:
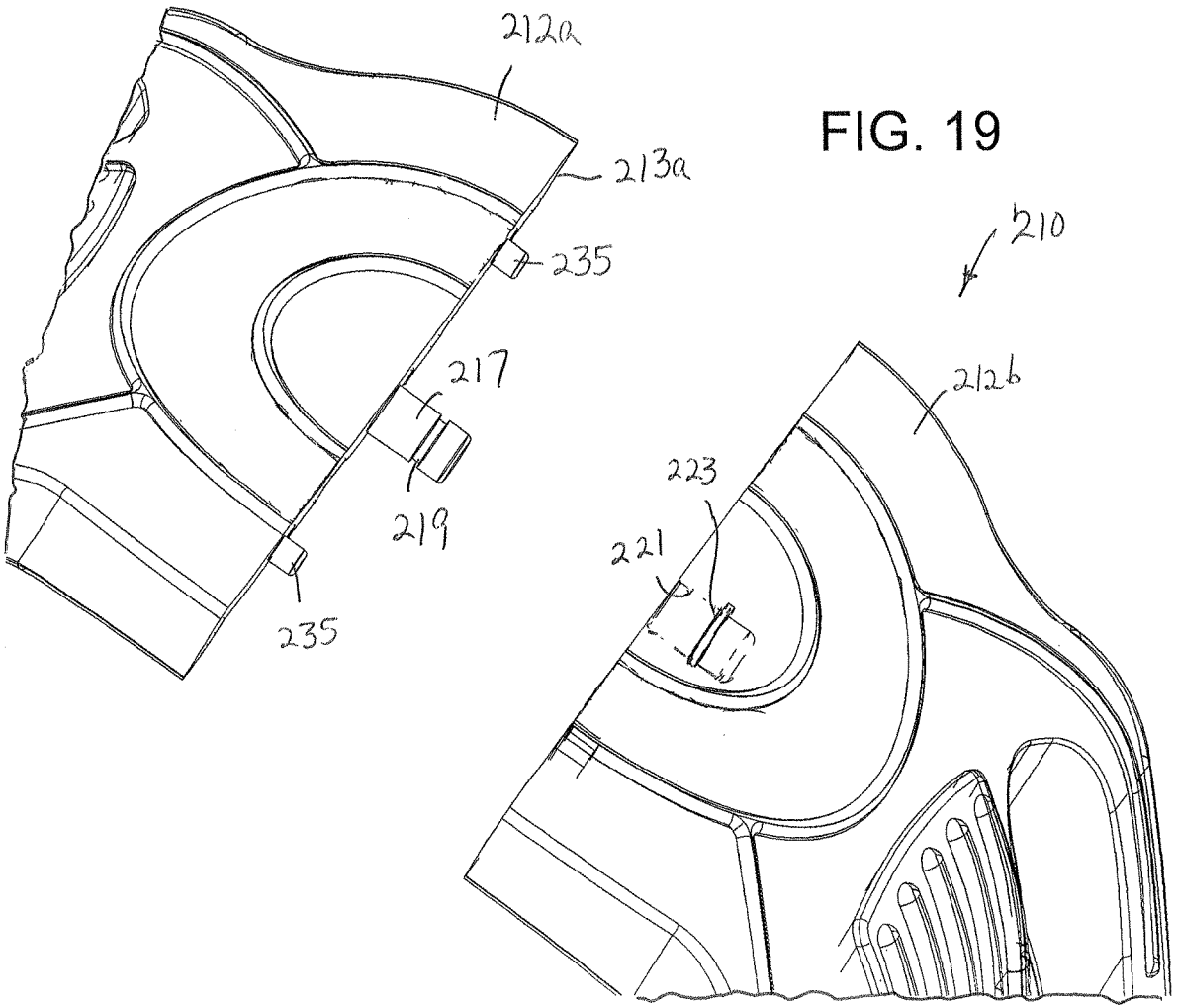
FIG. 19 is an enlarged, bottom perspective view of the dual shaving razor assembly of FIG. 16, from a second opposite direction.
Figure 20:
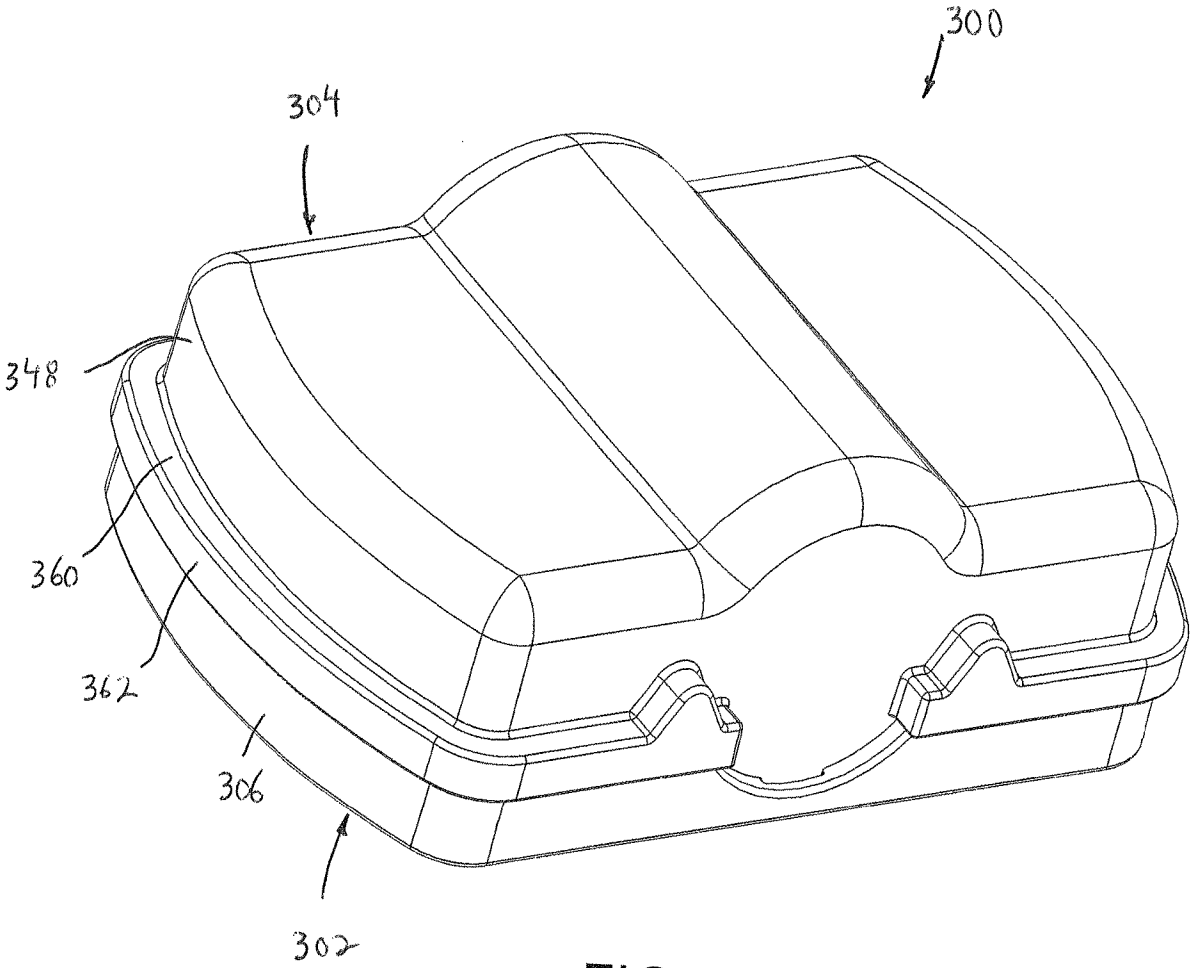
FIG. 20 is a top perspective view of a case for holding the dual shaving razor assemblies.
Figure 21:
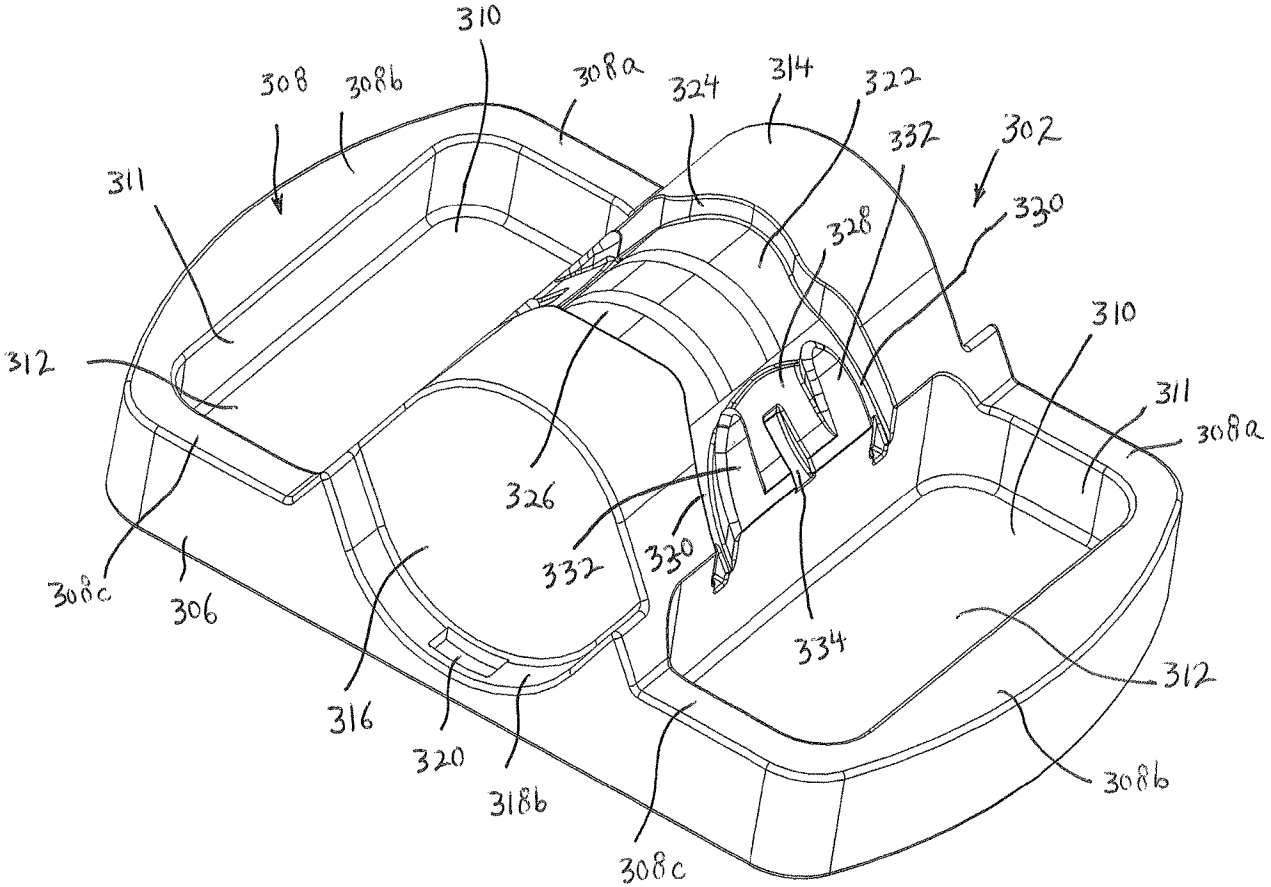
FIG. 21 is a top perspective view of the base.
Figure 22:
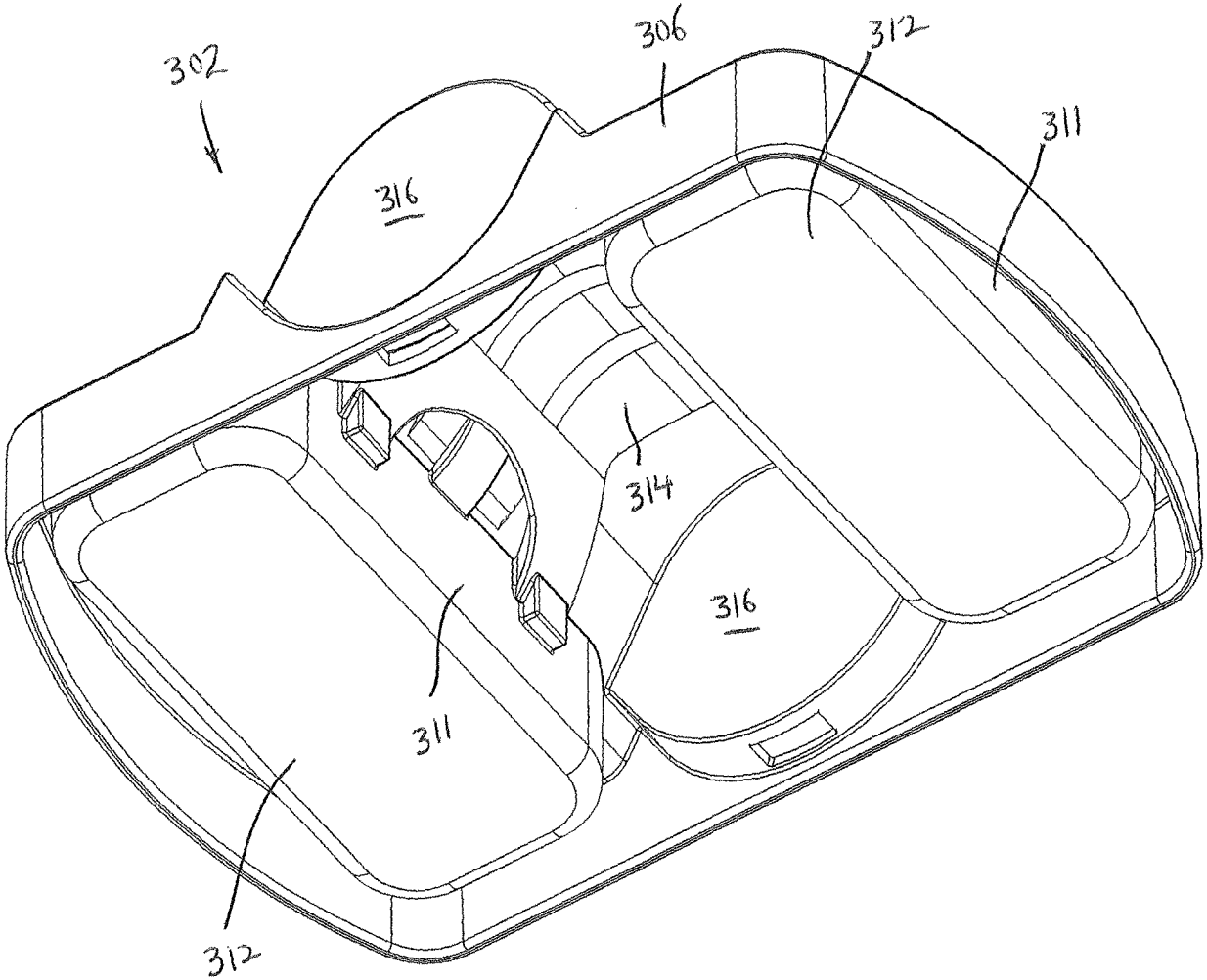
FIG. 22 is a bottom perspective view of the base.
Figure 23:
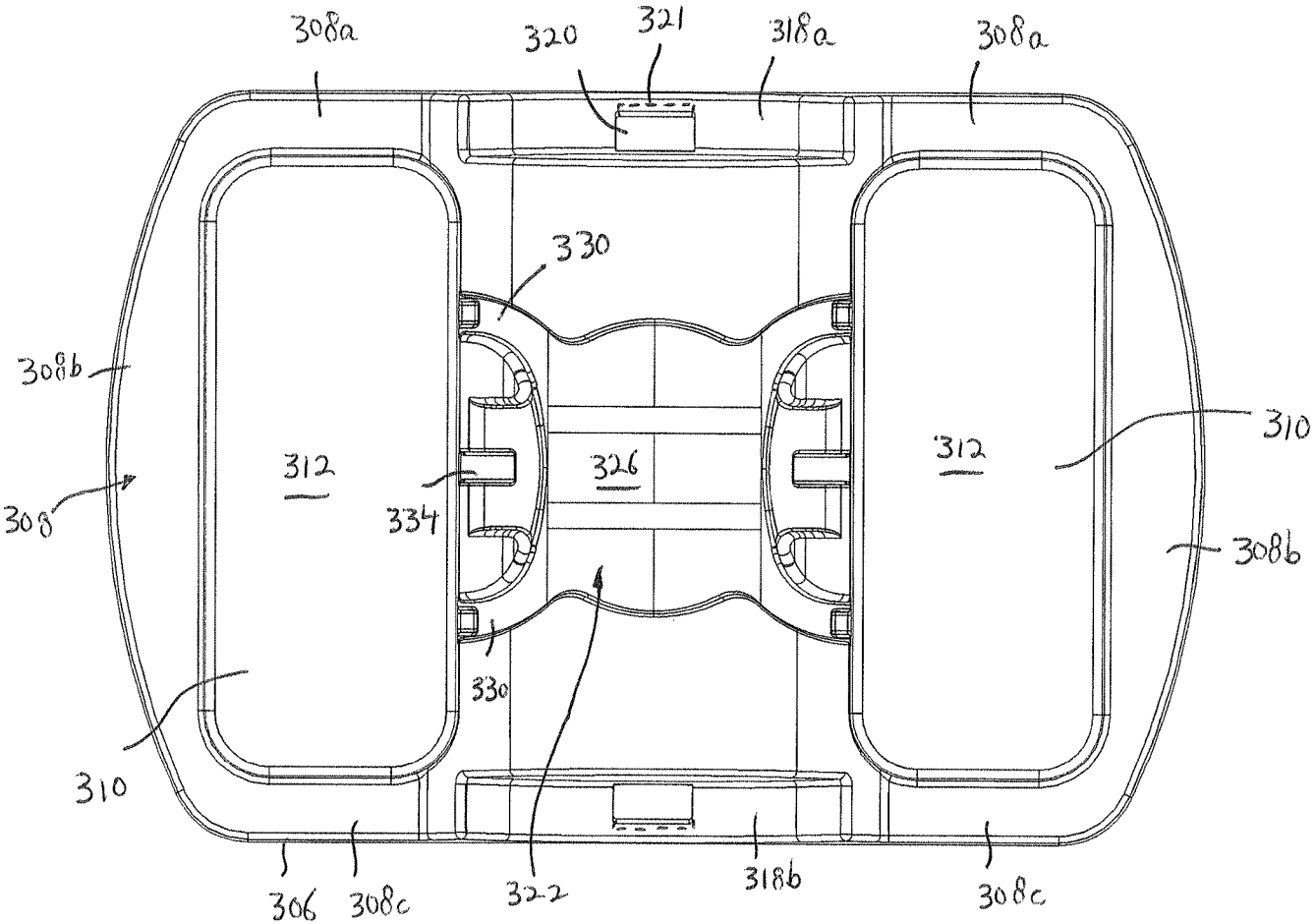
FIG. 23 is a top plan view of the base.
Figure 24:
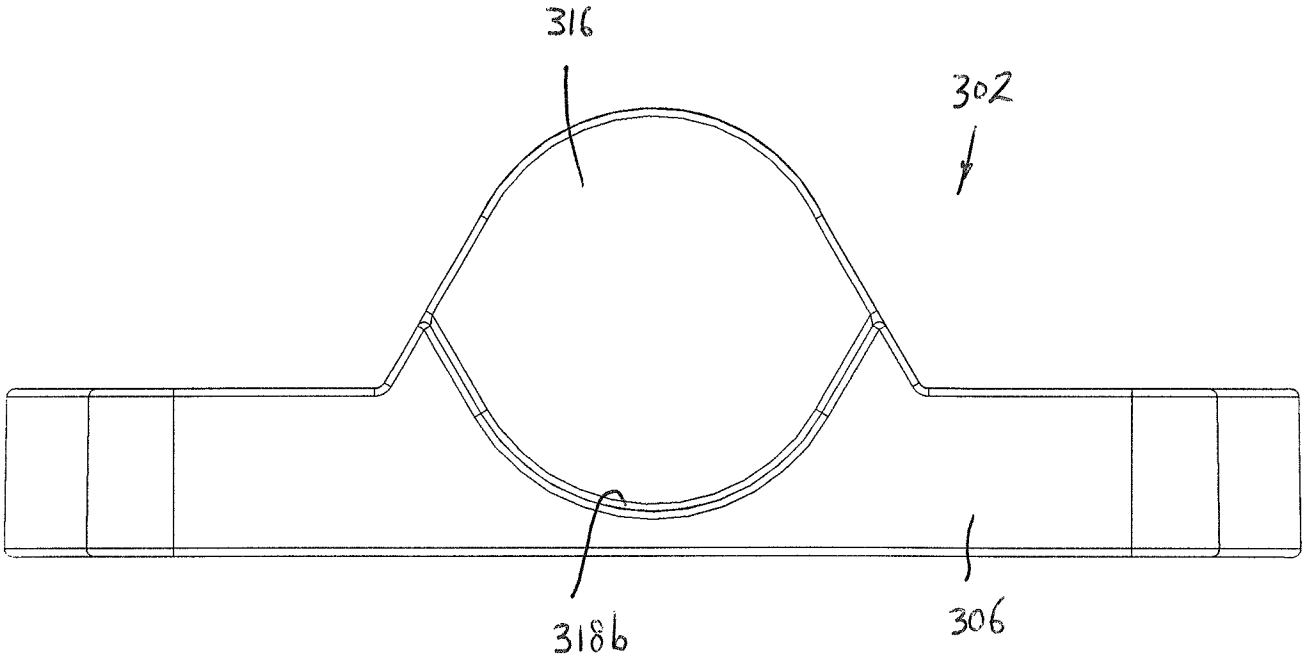
FIG. 24 is a side elevational view of the base.
Figure 25:
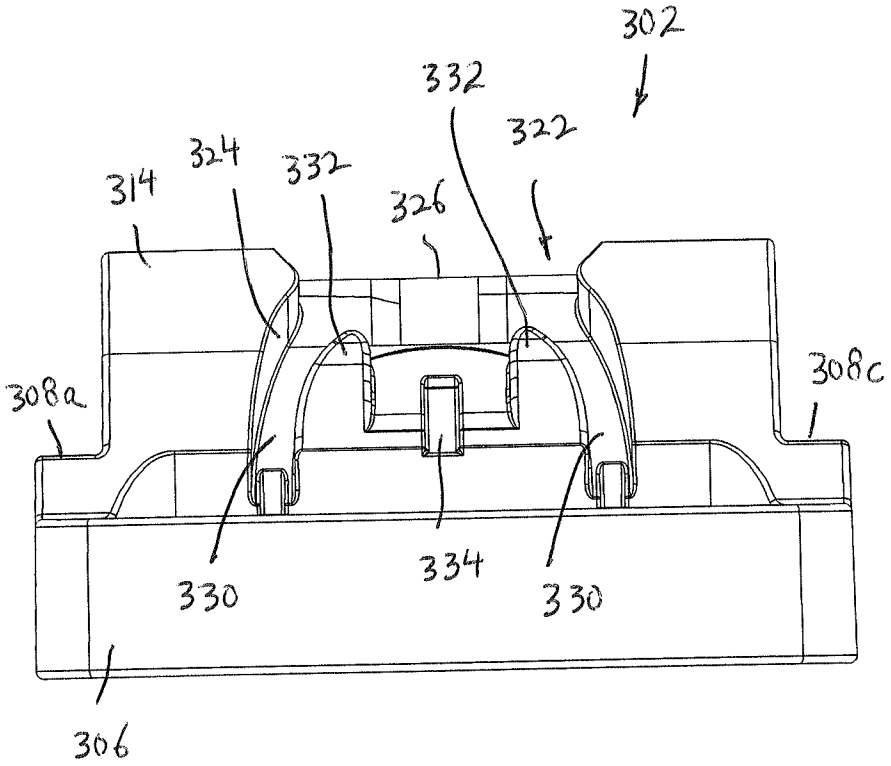
FIG. 25 is an end plan view of the base.
Figure 26:
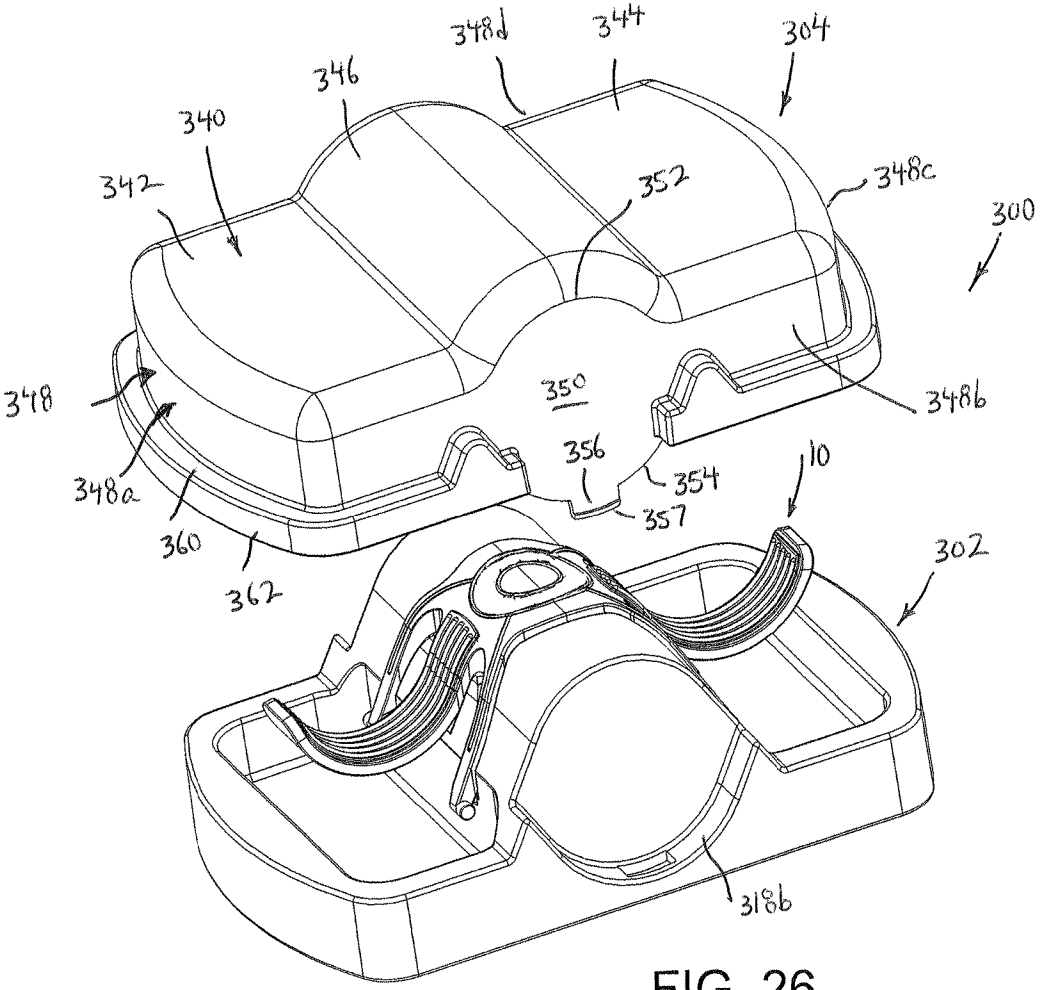
FIG. 26 is an exploded, top perspective view of the case, showing the base and cover.
Figure 27:
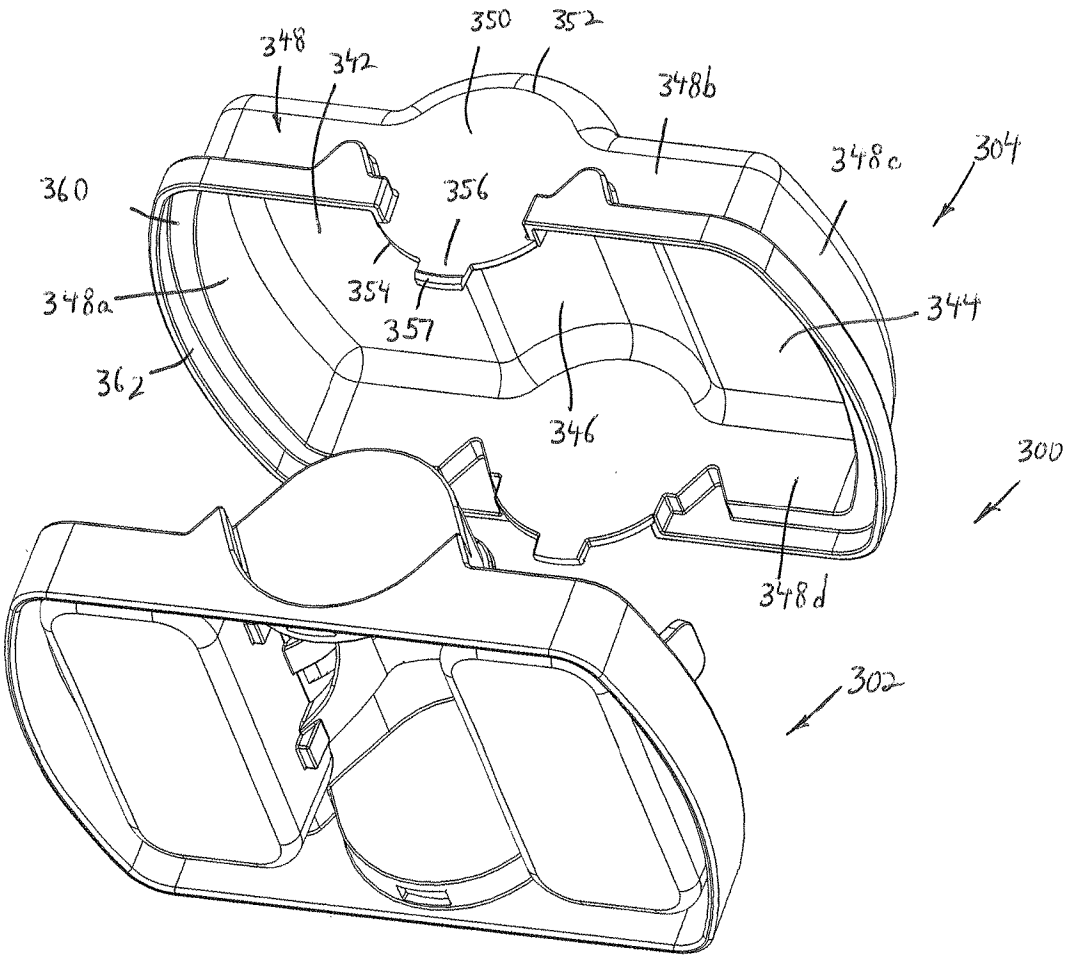
FIG. 27 is an exploded, bottom perspective view of the case, showing the base and cover.

In accordance with an important aspect of the present invention, legs 14 are flexible and resilient, so that a leg 14 can be pushed and deflected inwardly, that is, from a forward to rearward position and a rearward to forward position, and when the force is removed, each leg will return to its original unbiased position. In this regard, legs 14 are preferably constructed from a flexible and resilient plastic material, although the present invention is not limited thereto. In addition, in order to provide for such flexible and resilient characteristic, each leg 14 is preferably formed of a constant or uniform width or thickness throughout the length thereof, unlike the increasing width or thickness shown in FIG. 9 of U.S. Patent Publication No. 2016/0288350, which has the effect of rendering the legs relatively rigid and unflexible.

In this manner, shaving cartridges 18 can be secured to legs 14. Shaving cartridges 18 are preferably of the type shown in U.S. Patent Publication No. 2016/0288350, which are sold by Dorco USA, 2199 Britannia Blvd., San Diego, Calif. 92154-8807 under the trademark PACE. Specifically, each shaving cartridge 18 includes a plurality of parallel, angled blades 20 held in a cartridge housing 22. Although only three blades 20 are shown in FIG. 1, the present invention is not limited thereby, and preferably each shaving cartridge 18 includes four or six blades 20. The inner edge of cartridge housing 22 includes two parallel, spaced apart retaining walls 24, each having a cylindrical opening 26 therein which faces the other retaining wall 24. In this manner, legs 14*a* and 14*b* can be pressed inwardly toward each other, and positioned between retaining walls 24. When the biasing force is released, legs 14*a* and 14*b* will return to their original unbiased positions, whereby cylindrical pegs 16 will engage within cylindrical openings 26 to releasably hold a shaving cartridge 18. The same operation occurs with legs 14*c* and 14*d*.

It will be appreciated that, with this arrangement, shaving cartridges 18 are rotatably or pivotally mounted to legs 14, in order to conform to the curvature of the skin which is being shaved. Preferably, blades 20 of the leftmost shaving cartridge 18 are angled in a manner to shave when dual shaving razor assembly 10 is moved in the direction of arrow A in FIG. 1, and blades 20 of the rightmost shaving cartridge 18 are angled in a manner to shave when dual shaving razor assembly 10 is moved in the direction of arrow B in FIG. 1, although the present invention is not limited thereby.

In order to limit the rotation of each shaving cartridge 18, a triangular stop 28 is fixed to the undersurface of each leg 14 at the lower end thereof, immediately adjacent cylindrical pegs 16. A flat surface 30 is provided on each shaving cartridge 18 immediately inwardly of the respective retaining wall 24, and against which each triangular stop 28 is adapted to abut, to limit downward rotation of the opposite free edge of the shaving cartridge 18.

The lower surface of each triangular stop 28 can initially be positioned on and in contact with flat surface 30, or can be slightly spaced away from flat surface 30.

In order to limit the rotation of each shaving cartridge 18 in the opposite direction, an upstanding wall 31 is fixed to the upper surface of each cartridge housing 22 immediately behind each flat surface 30, and against which the respective leg 14 abuts during rotation of shaving cartridge 18. Each leg 14 can initially be positioned against upstanding wall 31, or can be slightly spaced away from upstanding wall 31.

As shown in FIG. 1, each shaving cartridge 18 includes a central crest wall 32. In accordance with an important aspect of the present invention, an elongated arcuate wing 34*a* extends forwardly from the front edge 12*a* of main body 12 between legs 14*a* and 14*b*, and an elongated arcuate wing 34*b* extends rearwardly from the rear edge 12*b* of main body 12 between legs 14*c* and 14*d*. Specifically, each arcuate wing 34*a* and 34*b* is downwardly bowed. Of importance to the present invention is that each arcuate wing 34*a* and 34*b* is flexible and resilient, so that it can be pressed down, and when the pressure is released, the arcuate wings 34*a* and 34*b* will return to their original unbiased positions.

Each arcuate wing 34*a* and 34*b* preferably includes a non-slip ribbed rubber upper surface 36, and an elongated narrow rib 38 is fixed centrally to the undersurface of each arcuate wing 34*a* and 34*b* and extends in the lengthwise direction thereof. Each rib 38 is positioned immediately above, or in contact with, crest wall 32.

It will be appreciated that, while wings 34*a* and 34*b* have been shown as arcuate members, the present invention is not limited thereto.

In operation, with shaving cartridges 18 secured to the ends of legs 14, a user places his or her middle finger at the underside of main arch-like body 12, with the person's ring finger on the non-slip ribbed rubber upper surface 36 of one arcuate wing 34*a* or 34*b*, and the person's index finger on the non-slip ribbed rubber upper surface 36 of the other arcuate wing 34*a* or 34*b*.

In this position, and initially, only one or two of inwardly positioned ones of the blades 20 of each cartridge 18 are in shaving contact with the skin. However, when the user merely presses down on arcuate wing 34*a* and/or 34*b*, the respective ribs 38 engage and slide along the respective crest walls 32 to pivot the opposite free outer edge of the shaving cartridge 18 downwardly away from main body 12 in order to position more of the blades 20 of the shaving cartridge 18 in contact with the skin to be shaved. For example, the leftmost shaving cartridge 18 in FIG. 1 is rotated counterclockwise while the rightmost shaving cartridge 18 in FIG. 1 is rotated clockwise. The downward pressure on the arcuate wings 34*a* and 34*b* also functions to adjust the pressure of the shaving cartridge 18 on the skin to be shaved.

It will be appreciated that this rotation of shaving cartridges 18 can occur in a number of ways, depending upon the construction. Specifically, where the lower ends of triangular stops 28 are in contact initially with flat surfaces 30 and legs 14 are in contact initially with upstanding walls 31, the application of a downward force on flexible and resilient arcuate wings 34*a* and 34*b* causes legs 14*a* and 14*b* to be moved inwardly toward legs 14*c* and 14*d*, and causes legs 14*c* and 14*d* to be moved inwardly toward legs 14*a* and 14*b*, functioning to pivot the leftmost shaving cartridge 18 in a counterclockwise direction and the rightmost shaving cartridge 18 in a clockwise direction, thereby forcing more of the blades 20 of each shaving cartridge 18 to be positioned on the skin, for example, where there is coarser hair or more hair to be shaved. Continued application of force on arcuate wings 34*a* and 34*b* results in more pressure being applied to the shaving cartridges 18 on the skin. When the pressure applied to wings 34*a* and 34*b* is removed, because of the resilient nature thereof, wings 34*a* and 34*b* will return to their original unbiased positions.

Further, in the event that, during shaving, the free outer edges of each shaving cartridge 18 are biased upwardly in a direction toward main body 12, for example, due to the contour of the skin surface, the central crest walls 32 will engage with and force wings 34*a* and 34*b* upwardly to permit this change in inclination.

It will further be appreciated that, because of the flexible and resilient nature of legs 14 and wings 34*a* and 34*b*, the inclination angle and pressure on each shaving cartridge 18 can be controlled, independently of the inclination angle and pressure on the other shaving cartridge 18.

Further, because of the different inclination angles of blades 20 on the two shaving cartridges 18, both shaving cartridges 18 are always in contact with the skin surface during a shaving operation, thereby avoiding the occurrence of nicks and cuts due to having to lift dual shaving razor assembly 10 from the skin surface, and then again place dual shaving razor assembly 10 on the skin surface for another shaving operation.

As discussed above, the lower surface of each triangular stop 28 can be slightly spaced away from flat surface 30, and each leg 14 can be slightly spaced away from upstanding wall 31. In such case, there would be a small rotation of each shaving cartridge 18 about cylindrical pegs 16, before each triangular stop 28 abuts against flat surface 30, and before each leg 14 abuts against upstanding wall 31. This would require even less force to rotate the shaving cartridges 18 initially, before legs 14 have to be biased further.

Therefore, unlike the above mentioned patent publications which provide a rigid securement of the shaving cartridges, the present invention, because of flexible and resilient arcuate wings 34*a* and 34*b*, functions to provide better shaving control as to the number of blades in contact with the skin surface and the pressure applied to the skin surface.

It will further be appreciated that different amounts of pressure can be applied separately to each arcuate wing 34*a* and 34*b* to separately and differently place the number of blades in contact with the skin of each shaving cartridge and the pressure of each shaving cartridge on the skin, independently of the other shaving cartridge. For example, in places on the skin where there is thicker and/or coarser hair, each cartridge 18 can be separately and independently pivoted to provide a greater number of blades and greater pressure on the skin.

Referring now to FIGS. 6-15, there is shown a dual shaving razor assembly 110 according to a second embodiment of the present invention. Dual shaving razor assembly 110 is constructed in the same manner as dual shaving razor assembly 10, except as indicated below, and common elements thereof are referred to by the same reference numerals.

Dual shaving razor assembly 110 differs from dual shaving razor assembly 10 by forming main arch-like body 112 into two body segments 112*a* and 112*b* which are pivotally connected to each other for transverse pivoting rotation, in order to provide more accurate and more controlled shaving, whereby shaving cartridges 18 more accurately adapt to the contour of skin surface.

In this regard, body segments 112*a* and 112*b* have inner planar surfaces 113*a* and 113*b*, respectively, that abut at a transverse centerline 115. In order to pivotally connect body segments 112*a* and 112*b*, body segment 112*a* includes a cylindrical projection 117 extending centrally out from planar surface 113*a*, with two diametrically opposite stop limit members 119 adjacent the free end of cylindrical projection 117.

A semi-cylindrical recess 121 is formed centrally in the underside of body segment 112*b*, and opens centrally at planar surface 113*b* thereof. Two diametrically opposite stop limit recesses 123 are provided at opposite sides of semi-cylindrical recess 121 and in communication with semi-cylindrical recess 121. As will be appreciated, semi-cylindrical recess 121 is adapted to rotatably receive cylindrical projection 117 therein when planar surfaces 113*a* and 113*b* are in abutting relation. In such position, stop limit members 119 fit within stop limit recesses 123 so as to be out of contact with the undersurface of body segment 112*b* by a small amount.

Five pins 125 extend from the undersurface of body segment 112*b* on opposite sides of semi-cylindrical recess 121 and stop limit recesses 123. A securement plate 127 is provided for rotatably securing cylindrical projection 117 in semi-cylindrical recess 121. Specifically, securement plate 127 includes a semi-cylindrical recess 129 of the same diameter as semi-cylindrical recess 121 and complementary thereto, so that when securement plate 127 is secured to the the underside of body segment 112*b*, semi-cylindrical recesses 121 and 129 together form a cylindrical opening for receiving cylindrical projection 117. Two diametrically opposite stop limit recesses 131 are provided at opposite sides of semi-cylindrical recess 129 and in communication with semi-cylindrical recess 129, with stop limit recesses 131 being positioned immediately below stop limit recesses 123, for receiving stop limit members 119 therein.

The upper surface of securement plate 127 includes five openings 133 on opposite sides of semi-cylindrical recess 129 and stop limit recesses 131, for receiving pins 125.

In this manner, after cylindrical projection 117 is positioned within semi-cylindrical recess 121, with stop limit members 119 positioned within stop limit recesses 123, an adhesive is applied to the upper surface of securement plate 127. Securement plate 127 is then positioned such that pins 125 are received within openings 133 thereof. In this position, semi-cylindrical recesses 121 and 129 are in alignment, and stop limit recesses 123 and 131 are in alignment, thereby capturing cylindrical projection 117 therein. With this arrangement, cylindrical pin 117 is permitted to rotate, limited only by stop limit members 119 hitting against an upper limit end surface of a respective stop limit recess 123 and the lower surface of the respective stop limit recess 131. As a result, body segments 112*a* and 112*b* can rotate relative to each other in a transverse direction about the axis of cylindrical projection 117. Preferably, the limit of such rotation is approximately six degrees.

Referring now to FIGS. 16-19, there is shown a dual shaving razor assembly 210 according to a third embodiment of the present invention. Dual shaving razor assembly 210 is constructed in the same manner as dual shaving razor assembly 110, except as indicated below, and common elements thereof are referred to by the same reference numerals.

Dual shaving razor assembly 210 differs from dual shaving razor assembly 110 in the manner that body segments 212*a* and 212*b* are pivotally connected together.

As with dual shaving razor assembly 110, dual shaving razor assembly 210 includes a main arch-like body 212 formed by two body segments 212*a* and 212*b* which are pivotally connected to each other for transverse pivoting rotation, in order to provide more accurate and more controlled shaving, whereby shaving cartridges 18 more accurately adapt to the contour of skin surface. In this regard, body segments 212*a* and 212*b* have inner planar surfaces 213*a* and 213*b*, respectively, that abut at a transverse centerline. However, the structure for pivotally connecting body segments 212*a* and 212*b* together is different than the pivoting structure of dual shaving razor assembly 110.

In order to pivotally connect body segments 212*a* and 212*b*, body segment 212*a* includes a cylindrical projection 217 extending centrally out from planar surface 213*a*. An annular recess 219 is provided in the outer surface of cylindrical projection 217, spaced slightly from the free end thereof.

A cylindrical recess 221 is formed centrally in the body segment 212*b*, and opens centrally at planar surface 213*b* thereof, for rotatably receiving cylindrical projection 217 therein. The undersurface of body segment 212*b* includes a transversely oriented slit-like opening 223 that opens into cylindrical recess 221. A horseshoe shaped clip 225 is adapted to extend within slit-like opening 223 and engage within annular recess 219 of cylindrical projection 217 in order to lock cylindrical projection 217 in cylindrical recess 221 in the axial direction thereof, while permitting rotation of cylindrical projection 217.

In order to limit the rotational extent of body segments 212*a* and 212*b* relative to each other, two limit pins 235 extend out from planar surface 213*a*, in parallel, spaced relation on opposite sides of cylindrical projection 217. Two slightly arcuate recesses 237 are formed in body segment 212*b* on opposite sides of cylindrical recess 221, with both opening at planar surface 213*b*. Each arcuate recess 237 is adapted to receive a respective limit pin 235. Limit pins 235 abut against upper and lower ends of arcuate recesses 237 in order to limit the angular extent of rotation of body segments 212*a* and 212*b* relative to each other.

The remaining structure of dual shaving razor assembly 210 is the same as dual shaving razor assemblies 10 and 110.

In order to safely dock each dual shaving razor assembly 10, 110 and 210 when not in use, in order to prevent damage to the dual shaving razor assembly and to provide for safe and easy transport thereof, a case 300 is provided, as shown in FIGS. 20-27. Case 300 includes a base 302 on which the dual shaving razor assembly is mounted, and a cover 304 for covering base 302 and encapsulating the dual shaving razor assembly therebetween.

Specifically, base 302 includes a peripheral side wall 306 of a generally rectangular shape, with slightly rounded end walls, and a top supporting wall 308 secured to the upper surface of side wall 306. Two rectangular recesses 310 are formed in opposite ends of top wall 308, each including a downwardly extending rectangular side wall 311 and a bottom wall 312. In this manner, top wall 308 includes three narrow top wall ledges 308*a*, 308*b* and 308*c* surrounding three sides of each recess 310.

Top wall 308 includes an upwardly arcuate or convex wall portion 314 between rectangular recesses 308, and which is connected to narrow top wall ledges 308*a* and 308*c*, and upper edges of side walls 311, at each end thereof. Convex wall portion 314 has a transverse widthwise dimension similar to that of each recess 310, and is closed at each side by an eye-shaped side wall 316. Further, top wall ledges 308*a* on each side of base 302 are connected together by a narrow downwardly arcuate or concave ledge 318*a* immediately to the outside of a respective eye-shaped side wall 316 and, top wall ledges 308*c* on each side of base 302 are connected together by a narrow downwardly arcuate or concave ledge 318*b* immediately to the outside of the other respective eye-shaped side wall 316. Each concave ledge 318*a* and 318*b* includes a shallow recess 320 centrally thereof, with each shallow recess 320 extending outwardly at the lower end thereof into an outwardly extending recess 321 shown only in dashed lines in FIG. 23.

Convex wall portion 314 includes a centrally located convex recess 322 along the entire length thereof, which is defined by opposite side walls 324 and a convex bottom wall 326, for receiving main arch-like bodies 12, 112, 212 thereon. A generally semi-circular stop wall 328 is formed at each lower end of convex wall portion 314 within centrally located convex recess 322, but is spaced from side walls 324 to define leg receiving passageways 330 between side walls 324 and semi-circular stop wall 328 for receiving legs 14 of the dual shaving razor assembly. Preferably, there are raised projections 332 on opposite sides of semi-circular stop wall 328 for further defining passageways 330. A shallow rectangular recess 334 is provided centrally in semi-circular stop wall 328 between raised projections 332 in order to receive an elongated narrow rib 38 of the dual shaving razor assembly.

With this arrangement, main arch-like body 12, 112, 212 of the dual shaving razor assembly sits on top of bottom wall 326 of convex wall portion 314, with legs 14 positioned within leg receiving passageways 330 and each elongated narrow rib 38 position within a respective shallow rectangular recess 334. In this position, shaving cartridges 18 sit within rectangular recesses 310. In addition, leg receiving passageways 330 and/or shallow rectangular recesses 334 can be dimensioned to receive the respective legs 14 and elongated narrow ribs 38 in a snap fitting relation to securely hold the dual shaving razor assembly in position, although the present invention is not limited thereto.

Cover 304 includes an upper wall 340 having planar end wall sections 342 and 344, connected together by an upwardly arcuate or convex wall section 346. A first skirt side wall 348 extends downwardly from the periphery of upper wall 340, and includes skirt side wall sections 348*a*-348*d*. Central portions 350 of side wall sections 348*b* and 348*d*, corresponding to the position of convex wall section 346, thereby curve upwardly at upper edges 352 thereof to meet side edges of convex wall section 346. In addition, central portions 350 include downwardly arcuate or convex lower edges 354 that have a curvature complementary to the curvature of concave ledges 318*a* and 318*b* for seating thereon. A tab 356 extends downwardly from the center of each convex lower edge 354 for seating within a respective shallow recess 320 and includes an outwardly extending lip 357 at the lower end thereof for engaging within outwardly extending recess 321 in order to correctly position and lock cover 304 on base 302. Because tabs 356, and side wall sections 348*b* and 348*d*, are flexible and resilient, outwardly extending lips 357 engage within outwardly extending recesses 321 for a locking action. To remove cover 304, it is only necessary to squeeze tabs 356 and side wall sections 348*b* and 348*d* inwardly toward each other, thereby releasing outwardly extending lips 357 from outwardly extending recesses 321, whereby cover 304 can be lifted up and removed from base 302.

A horizontal ledge 360 extends outwardly from the lower edge of skirt side wall 348 in surrounding relation to planar end wall sections 342 and 344, and a second skirt side wall 362 extends downwardly from the periphery of each horizontal ledge 360. In this manner, when cover 304 is seated on base 302, horizontal ledges 360 sit on top of top wall ledges 308*a*, 308*b* and 308*c*, and second skirt side wall 362 fits around side wall 306.

Alternatively, second skirt side wall 362 can merely snap around side wall 306 to removably secure cover 304 to base 302.

With this arrangement, the dual shaving razor assembly can be safely held within case 300 without damage to the blades 20 of shaving cartridges 18, and without injury to a person, while also providing for easy transport of the dual shaving razor assembly.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. A dual shaving razor assembly comprising:

a central main body;

a first pair of first and second legs extending down from a first side of the main body in spaced relation to each other, the first and second legs having free distal ends which are unconnected with each other;

a second pair of third and fourth legs extending down from an opposite second side of the main body in spaced relation to each other, the third and fourth legs having free distal ends which are unconnected with each other;

said first pair of legs including a first securing arrangement for securing a first shaving cartridge having blades thereto to the free distal ends of the respective pair of legs such that said first shaving cartridge is adapted to pivot relative to the main body at the first securing arrangement and such that the blades of the first shaving cartridge are oriented for shaving in a first shaving direction;

said second pair of legs including a second securing arrangement for securing a second shaving cartridge having blades thereto to the free distal ends of the respective pair of legs such that said second shaving cartridge is adapted to pivot relative to the main body at the second securing arrangement and such that the blades of the second shaving cartridge are oriented for shaving in a second shaving direction which is opposite to said first shaving direction;

a first flexible and resilient wing extending from the first side of the main body and positioned between said first pair of legs and out of contact with said first pair of legs to a position immediately above the first shaving cartridge held by the first pair of legs, said first wing being engageable by a first finger of a person during a shaving operation and being bendable upon application of pressure thereto by the person's first finger to engage an upper surface of the first shaving cartridge to pivot the first shaving cartridge relative to the main body at the first securing arrangement upon application of an external force to the first flexible and resilient wing;

a second flexible and resilient wing extending from the second side of the main body and positioned between said second pair of legs and out of contact with said second pair of legs to a position immediately above the second shaving cartridge held by the second pair of legs, said second wing being engageable by a second finger of the person during a shaving operation and being bendable upon application of pressure thereto by the person's second finger to engage an upper surface of the second shaving cartridge to pivot the second shaving cartridge relative to the main body at the second securing arrangement, independently of any pivoting of the first shaving cartridge, upon application of an external force to the second flexible and resilient wing;

wherein the blades of the first shaving cartridge are in non-shaving contact with a person's skin when the blades of the second shaving cartridge are moved in shaving contact with the person's skin, and wherein the blades of the second shaving cartridge are in non-shaving contact with a person's skin when the blades of the first shaving cartridge are moved in shaving contact with the person's skin, such that the dual shaving razor assembly is adapted for back and forth shaving motion with the blades of both the first and second shaving cartridges in contact with the person's skin.

2. A dual shaving razor assembly according to claim 1, wherein each said securing arrangement includes a pivot securing arrangement for pivotally securing each razor cartridge to one said pair of legs.

3. A dual shaving razor assembly according to claim 2, wherein each razor cartridge has opposed cylindrical openings, and each said pivot securing arrangement includes cylindrical pegs adapted to be rotatably received in said opposed cylindrical openings.

4. A dual shaving razor assembly according to claim 1, wherein said legs are flexible and resilient to permit said pivoting of the shaving cartridges relative to the main body in a lengthwise direction of the dual shaving razor assembly.

5. A dual shaving razor assembly according to claim 4, wherein said legs have a length with a generally constant thickness throughout the length.

6. A dual shaving razor assembly according to claim 1, wherein said main body has an arcuate shape for receiving a middle finger therebeneath and each said wing has an arcuate shape for receiving one of an index finger and ring finger thereon.

7. A dual shaving razor assembly according to claim 1, wherein each wing has an upper surface with a non-slip material thereon.

8. A dual shaving razor assembly according to claim 1, wherein each wing has an elongated narrow rib on an underside thereof for engaging with a crest wall on an upper surface of the respective shaving cartridge.

9. A dual shaving razor assembly according to claim 1, wherein said main body includes a first body segment and a second body segment rotatable relative to each other at a central bisecting plane of said main body in a transverse twisting direction.

10. A dual shaving razor assembly according to claim 9, wherein said first body segment and said second body segment include mutually facing surfaces.

11. A dual shaving razor assembly according to claim 10, wherein said first body segment includes a central opening which extends through said surface thereof, and said second body segment includes a projection extending from said surface thereof and which is rotatably received in said central opening.

12. A dual shaving razor assembly according to claim 11, further comprising a securement plate for capturing said projection in said central opening.

13. A dual shaving razor assembly comprising:

a central main body;

a first pair of legs extending down from a first side of the main body in spaced relation to each other;

a second pair of legs extending down from an opposite second side of the main body in spaced relation to each other;

each pair of legs including a securing arrangement for securing a shaving cartridge having blades thereto such that each shaving cartridge is adapted to pivot relative to the main body;

a first flexible and resilient wing extending from the first side of the main body between said first pair of legs to a position immediately above a respective first shaving cartridge held by the first pair of legs, and adapted to engage an upper surface of the first shaving cartridge to pivot the first shaving cartridge relative to the main body upon application of an external force to the first flexible and resilient wing;

a second flexible and resilient wing extending from the second side of the main body between said second pair of legs to a position immediately above a respective second shaving cartridge held by the second pair of legs, and adapted to engage an upper surface of the second shaving cartridge to pivot the second shaving cartridge relative to the main body, independently of any pivoting of the first shaving cartridge, upon application of an external force to the second flexible and resilient wing;

wherein said main body includes a first body segment and a second body segment rotatable relative to each other in a transverse twisting direction;

wherein said first body segment and said second body segment include mutually facing surfaces;

wherein said first body segment includes a central opening which extends through said surface thereof, and said second body segment includes a projection extending from said surface thereof and which is rotatably received in said central opening;

wherein:

said first body segment includes a slot at a lower surface thereof in communication with said central opening, and said projection includes an annular recess; and further comprising a clip for insertion in said slot for engagement in said annular recess to prevent axial movement of said projection in said central opening, while permitting rotation of said projection in said central opening.

14. A dual shaving razor assembly according to claim 11, wherein said first body segment includes at least one recess to one side of said central opening, and further including at least one stop member received in said at least one recess for limiting an angular extent of rotation of said projection in said central opening.

15. A dual shaving razor assembly according to claim 14, wherein each said recess is in open communication with said central opening, and each said stop member extends radially from said projection.

16. A dual shaving razor assembly according to claim 14, wherein each said recess is spaced from said central opening, and each said stop member includes a projection extending from said surface of said second body segment and which is rotatably received in said recess.

17. A dual shaving razor assembly and a case for holding the dual shaving razor assembly, comprising:

dual shaving razor assembly comprising:

a central main body;

a first pair of legs extending down from a first side of the main body in spaced relation to each other;

a second pair of legs extending down from an opposite second side of the main body in spaced relation to each other;

each pair of legs including a securing arrangement for securing a shaving cartridge having blades thereto such that each shaving cartridge is adapted to pivot relative to the main body;

a first flexible and resilient wing extending from the first side of the main body between said first pair of legs to a position immediately above a respective first shaving cartridge held by the first pair of legs, and adapted to engage an upper surface of the first shaving cartridge to pivot the first shaving cartridge relative to the main body upon application of an external force to the first flexible and resilient wing;

a second flexible and resilient wing extending from the second side of the main body between said second pair of legs to a position immediately above a respective second shaving cartridge held by the second pair of legs, and adapted to engage an upper surface of the second shaving cartridge to pivot the second shaving cartridge relative to the main body, independently of any pivoting of the first shaving cartridge, upon application of an external force to the second flexible and resilient wing; and a case for holding the dual shaving razor assembly comprising:

a base including:

a center convex wall portion having a central recess in an upper surface thereof for supporting the main body thereon, first and second leg receiving passageways in said convex wall portion on opposite sides of said central recess for receiving the legs of the dual razor shaving assembly, and a recess adjacent each end of the center convex wall portion, each for receiving a respective shaving cartridge securing to ends of each pair of legs; and a cover adapted to be removably secured to said base in covering relation to the dual razor shaving assembly mounted to said base.

18. A dual shaving razor assembly and case according to claim 17, wherein each wing has an elongated narrow rib on an underside thereof for engaging with a crest wall on an upper surface of the respective shaving cartridge, and said center convex wall portion further includes a recess for receiving a respective said rib.

19. A dual shaving razor assembly and case according to claim 17, wherein said base further includes recesses on opposite sides of said center convex wall portion, and said cover includes side walls with tabs adapted to be received in said recesses for removably securing the cover to the base.

20. A dual shaving razor assembly according to claim 1, wherein the wings are out of contact with the respective shaving cartridges in an unbiased state thereof.

* * * * *